US011199350B2

(12) United States Patent
Matsui et al.

(10) Patent No.: US 11,199,350 B2
(45) Date of Patent: Dec. 14, 2021

(54) AIR-CONDITIONING APPARATUS WITH REGULATED FLOW OF A HEAT MEDIUM

(71) Applicant: Mitsubishi Electric Corporation, Tokyo (JP)

(72) Inventors: Ryosuke Matsui, Tokyo (JP); Koji Azuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 33 days.

(21) Appl. No.: 16/632,576

(22) PCT Filed: Sep. 22, 2017

(86) PCT No.: PCT/JP2017/034312
§ 371 (c)(1),
(2) Date: Jan. 21, 2020

(87) PCT Pub. No.: WO2019/058506
PCT Pub. Date: Mar. 28, 2019

(65) Prior Publication Data

US 2020/0208892 A1 Jul. 2, 2020

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/004* (2013.01);
(Continued)

(58) Field of Classification Search
CPC ..... F25B 13/00; F25B 2313/004; F25B 2313/0233; F25B 2313/0315; F25B 2600/2515; F25B 49/02
See application file for complete search history.

(56) References Cited

U.S. PATENT DOCUMENTS

2008/0295530 A1* 12/2008 Sawada ..... B60H 1/3205 62/129
2013/0098073 A1* 4/2013 Cho ..... F25B 49/02 62/79

(Continued)

FOREIGN PATENT DOCUMENTS

JP H01-314840 A 12/1989
JP 2004-293844 A 10/2004

(Continued)

OTHER PUBLICATIONS

International Search Report of the International Searching Authority dated Nov. 21, 2017 for the corresponding International application No. PCT/JP2017/034312 (and English translation).

*Primary Examiner* — Henry T Crenshaw
(74) *Attorney, Agent, or Firm* — Posz Law Group, PLC

(57) ABSTRACT

An air-conditioning apparatus includes a refrigerant circuit, a heat medium circuit, and a controller. In the refrigerant circuit, a compressor, a heat-source-side heat exchanger, an expansion unit, and a load-side heat exchanger are connected by refrigerant pipes, and refrigerant flows. The heat-source-side heat exchanger causes heat exchange to be performed between the refrigerant and a heat-source heat medium. The load-side heat exchanger causes heat exchange to be performed between the refrigerant and a load heat medium, and refrigerant flows. In the heat medium circuit, a flow control valve that regulates the flow rate of the heat-source heat medium and the heat-source-side heat exchanger are connected by a heat medium pipe, and the heat-source heat medium flows. The controller includes a storage unit that stores data indicating a defined maximum flow rate and a defined minimum flow rate of the heat-source heat medium that flows in the heat medium circuit.

7 Claims, 10 Drawing Sheets

(52) U.S. Cl.
CPC ..... *F25B 2313/0233* (2013.01); *F25B 2313/0315* (2013.01); *F25B 2600/2515* (2013.01)

(56) References Cited

U.S. PATENT DOCUMENTS

| | | | | |
|---|---|---|---|---|
| 2017/0130996 | A1* | 5/2017 | Hatanaka | F24F 11/89 |
| 2017/0198945 | A1* | 7/2017 | Azuma | F25B 47/006 |
| 2020/0208892 | A1* | 7/2020 | Matsui | F25B 13/00 |

FOREIGN PATENT DOCUMENTS

| | | | |
|---|---|---|---|
| JP | 2005-351587 | A | 12/2005 |
| JP | 2009-030823 | A | 2/2009 |
| JP | 2009-031866 | A | 2/2009 |
| WO | 2015/114839 | A1 | 8/2015 |
| WO | 2015/162679 | A1 | 10/2015 |

* cited by examiner

AIR-CONDITIONING APPARATUS WITH REGULATED FLOW OF A HEAT MEDIUM

CROSS REFERENCE TO RELATED APPLICATION

This application is a U.S. national stage application of PCT/JP2017/034312 filed on Sep. 22, 2017, the contents of which are incorporated herein by reference.

TECHNICAL FIELD

The present invention relates to an air-conditioning apparatus including a heat-source-side heat exchanger that causes heat exchange to be performed with a heat-source heat medium that flows in a heat medium circuit.

BACKGROUND ART

In the past, a water-cooled air-conditioning apparatus has been known. A water-cooled air-conditioning apparatus includes a heat source apparatus provided with a heat-source-side heat exchanger that causes heat exchange to be performed with a heat-source heat medium such as water that flows in, for example, a heat medium circuit. To regulate the flow rate of the heat-source heat medium, an air-conditioning apparatus includes a flow control valve that regulates the flow rate of the heat-source heat medium and is provided in the heat medium circuit in which the heat-source heat medium flows. The flow control valve is controlled in interlock with the operation of the air-conditioning apparatus. Patent Literature 1 discloses a water-cooled air conditioning apparatus in which heat is transferred between refrigerant and cooling water that flows through a cooling water pipe, in an outdoor-side water heat exchanger provided on an outdoor side. At the cooling water pipe, a water flow control valve is provided. The water flow control valve is used to regulate the flow rate of the cooling water that flows through the cooling water pipe. A controller disclosed in Patent Literature 1 reduces the opening degree of the water flow control valve when the rotation speeds of a compressor and an indoor fan are low, thereby reducing the flow rate of water that flows through the cooling water pipe.

CITATION LIST

Patent Literature

Patent Literature 1: Japanese Unexamined Patent Application Publication No. 1-314840

SUMMARY OF INVENTION

Technical Problem

In the water-cooled air conditioning apparatus disclosed in Patent Literature 1, the flow rate of cooling water that flows in an outdoor-side water heat exchanger varies within a predetermined range from a lower-limit flow rate to an upper-limit flow rate in accordance with an air-conditioning load. The lower-limit flow rate and the upper-limit flow rate are determined in accordance with a flow-rate capacity of the water-cooled air conditioning apparatus. Therefore, in the water-cooled air conditioning apparatus, it is necessary to determine the maximum opening degree and the minimum opening degree of the water flow control valve in association with the upper-limit flow rate and the lower-limit flow rate, respectively. In an existing water-cooled air conditioning apparatus, at the actual place, an operator performs a trial operation of the water-cooled air conditioning apparatus to regulate the maximum opening degree and the minimum opening degree of the water flow control valve. However, since the operator manually regulates the water flow control valve, it takes long time to regulate it, and regulation of the water-flow control valve varies from that by one operator to that by another operator, since the operators have different technical skills.

The present invention has been made to solve the above problems, and an object of the invention is to provide an air-conditioning apparatus in which the time required to regulate a flow control valve is reduced and the variation between regulation processing by different operators is also reduced.

Solution to Problem

An air-conditioning apparatus according to an embodiment of the present invention includes a refrigerant circuit, a heat medium circuit, and a controller. In the refrigerant circuit, a compressor, a heat-source-side heat exchanger, an expansion unit, and a load-side heat exchanger are connected by refrigerant pipes, and refrigerant flows. The compressor compresses the refrigerant. The heat-source-side heat exchanger causes heat exchange to be performed between the refrigerant and a heat-source heat medium. The expansion unit expands the refrigerant. The load-side heat exchanger causes heat exchange to be performed between the refrigerant and a load heat medium, and refrigerant flows. In the heat medium circuit, a flow control valve that regulates the flow rate of the heat-source heat medium and the heat-source-side heat exchanger are connected by a heat medium pipe, and the heat-source heat medium flows. The controller includes a storage unit that stores data indicating a defined maximum flow rate and a defined minimum flow rate of the heat-source heat medium that flows in the heat medium circuit.

Advantageous Effects of Invention

According to the embodiment of the present invention, the controller stores the data indicating the defined maximum flow rate and the defined minimum flow rate of the heat source hear medium that flows in the heat medium circuit. Thus, the controller can automatically regulate the opening degree of the flow control valve based on the defined maximum flow rate and the defined minimum flow rate. It is therefore possible to reduce the time required to regulate the opening degree of the flow control valve and also reduce the variation between regulation processing by different operators.

DESCRIPTION OF EMBODIMENTS

Embodiment 1

Figure 1:
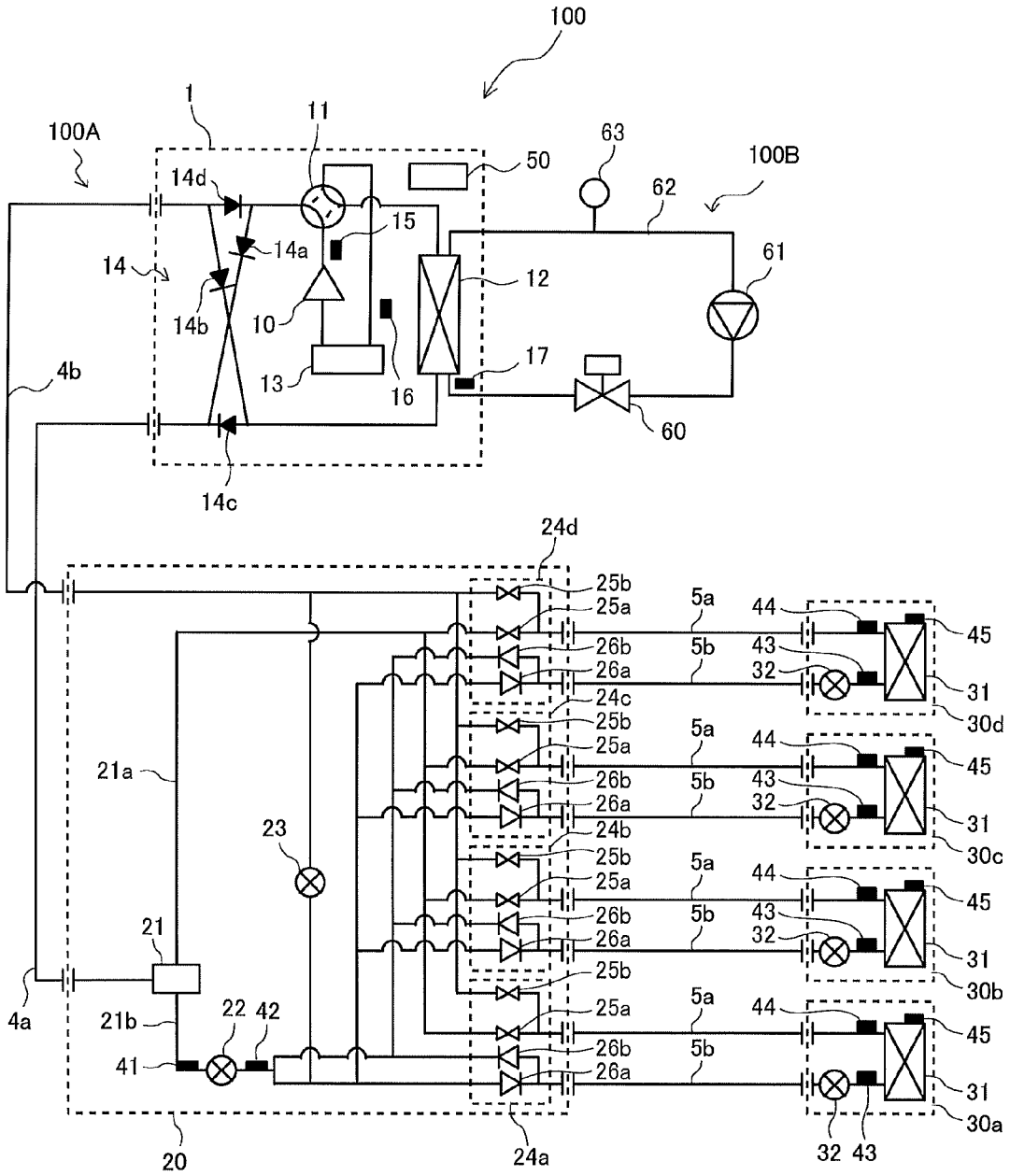
FIG. 1 is a circuit diagram of an air-conditioning apparatus 100 according to Embodiment 1 of the present invention.

An embodiment of an air-conditioning apparatus according to the present invention will be described with reference to the drawings. FIG. 1 is a circuit diagram of an air-conditioning apparatus 100 according to Embodiment 1 of the present invention. As illustrated in FIG. 1, the air-conditioning apparatus 100 includes a heat source apparatus 1, a plurality of indoor units 30*a* to 30*d*, a relay device 20, and a controller 50. Embodiment 1 will be described by referring to by way of example the case where that the heat source apparatus 1 is connected to four indoor units 30*a* to 30*d*. However, the number of heat source apparatuses 1 may be one, two, three, or more than four.

As illustrated in FIG. 1, the air-conditioning apparatus 100 includes a refrigerant circuit 100A in which the heat source apparatus 1, the indoor units 30*a* to 30*d*, and the relay device 20 are connected by a high-pressure pipe 4*a*, a low-pressure pipe 4*b*, and refrigerant pipes 5*a* and 5*b*. The heat source apparatus 1 has a function of supplying cooling energy or heating energy to the four indoor units 30*a* to 30*d*. The four indoor units 30*a* to 30*d* are connected parallel to each other and have the same configuration. Each of the indoor units 30*a* to 30*d* has a function of cooling or heating an air-conditioned space such as indoor space with the cooling energy or the heating energy supplied from the heat source apparatus 1.

The relay device 20 is provided between the heat source apparatus 1 and the indoor units 30*a* to 30*d*, and has a function of changing the flow of refrigerant supplied from the heat source apparatus 1 in response to a request from each of the indoor units 30*a* to 30*d*. The air-conditioning apparatus 100 also includes a heat medium circuit 100B that supplies a heat-source heat medium to the heat source apparatus 1.

The air-conditioning apparatus 100 also includes various sensors. The air-conditioning apparatus 100 includes, for example, a discharge pressure sensor 15, a suction pressure sensor 16, a heat medium temperature sensor 17, a first load temperature sensor 43, a second load temperature sensor 44, an air temperature sensor 45, a first pressure sensor 41, and a second pressure sensor 42.

It should be noted that the air-conditioning apparatus 100 has as operation modes, a cooling only operation, a heating only operation, a cooling main operation, and a heating main operation. The cooling only operation is an operation in which all the indoor units 30*a* to 30*d* perform cooling operation. The heating only operation is an operation which all the indoor units 30*a* to 30*d* perform heating operation. The cooling main operation is an operation in which cooling and heating mixed operation is performed such that the capacity of cooling operation is larger than the capacity of heating operation. Heating main operation is a mode in which cooling and heating mixed operation is performed such that the capacity of heating operation is larger than the capacity of cooling operation.

(Heat Source Apparatus 1)

The heat source apparatus 1 is installed outside a structure such as a building or a house. The heat source apparatus 1 may be provided in a space in a building, such as a machine room. The heat source apparatus 1 supplies cooling energy or heating energy to the four indoor units 30*a* to 30*d* via the relay device 20. The heat source apparatus 1 includes a compressor 10, a first flow switching device 11, a heat-source-side heat exchanger 12, an accumulator 13, and a heat-source-side flow regulating unit 14.

The compressor 10 compresses sucked refrigerant into high-temperature, high-pressure refrigerant, and discharges the high-temperature, high-pressure refrigerant. A discharge side of the compressor 10 is connected to the flow switching device 11, and a suction side of the compressor 10 is connected to the accumulator 13. As the compressor 10, for example, an inverter compressor whose capacity can be controlled is used. As the first flow switching device 11, for example, a four-way valve is used, and the first flow switching device 11 changes the flow direction of the refrigerant in a switching manner in accordance with an operation mode. In the cooling operation, the first flow switching device 11 connects the discharge side of the compressor 10 and the heat-source-side heat exchanger 12, and connects the heat-source-side flow regulating unit 14 and a suction side of the accumulator 13. In the heating operation, the first flow switching device 11 connects the discharge side of the compressor 10 and the heat-source-side flow regulating unit 14, and connects the heat-source-side heat exchanger 12 and the suction side of the accumulator 13. It should be noted that although it is illustrated by way of example that the first flow switching device 11 is a four-way valve, the first flow switching device 11 may be a combination of two-way valves or three-way valves.

The heat-source-side heat exchanger 12 is, for example, a plate-type heat exchanger that transfers heat between the refrigerant that flows in a plate and the heat-source heat medium that flows in the plate. One side of the heat-source-side heat exchanger 12 is connected to the first flow switching device 11 and the other side of the heat-source-side heat exchanger 12 is connected to a high-pressure pipe 4*a* via the heat-source-side flow regulating unit 14. The heat-source-side heat exchanger 12 operates as a radiator during the cooling operation, and operates as an evaporator during the heating operation. The accumulator 13 stores surplus refrigerant the amount of which corresponds to the difference between the amount of the refrigerant that flows during the heating operation and the amount of the refrigerant that flows during the cooling operation. The accumulator 13 also stores surplus refrigerant caused by a transitional operation change such as a change in the number of ones of the indoor units 30*a* to 30*d* that are in operation. One side of the accumulator 13 is connected to the suction side of the compressor 10, and the other side of the accumulator 13 is connected to the first flow switching device 11.

The heat-source-side flow regulating unit 14 controls the refrigerant that flows from the heat source apparatus 1 to the relay device 20 such that during the cooling operation and the heating operation, the refrigerant flows in respective directions. The heat-source-side flow regulating unit 14 includes a first check valve 14*a*, a second check valve 14*b*, a third check valve 14*c*, and a fourth check valve 14*d*. The first check valve 14*a* is provided at a pipe connecting the first flow switching device 11 and the high-pressure pipe 4*a*, and allows the refrigerant to flow from the first flow switching device 11 toward the high-pressure pipe 4*a*. The second check valve 14*b* is provided at a pipe connecting the heat-source-side heat exchanger 12 and the low-pressure pipe 4*b*, and allows the refrigerant to flow from the low-pressure pipe 4*b* toward the heat-source-side heat exchanger 12. The third check valve 14*c* is provided at a pipe connecting the heat-source-side heat exchanger 12 and the high-pressure pipe 4*a*, and allows the refrigerant to flow from the heat-source-side heat exchanger 12 toward the high-pressure pipe 4*a*. The fourth check valve 14*d* is provided at a pipe connecting the first flow switching device 11 and the low-pressure pipe 4*b*, and allows the refrigerant to flow from the low-pressure pipe 4*b* toward the first flow switching device 11.

The heat source apparatus 1 also includes a discharge pressure sensor 15, a suction pressure sensor 16, and a heat medium temperature sensor 17. The discharge pressure sensor 15 detects the pressure of the refrigerant that flows between the compressor 10 and the first flow switching device 11. The suction pressure sensor 16 detects the pressure of the refrigerant that flows between the first flow switching device 11 and the accumulator 13. The heat medium temperature sensor 17 detects the temperature of the heat-source heat medium that flows in the heat medium circuit 100B. It should be noted that each of the discharge pressure sensor 15 and the suction pressure sensor 16 may be provided at other refrigerant pipes in the heat source apparatus 1 or provided in the relay device 20.

(Indoor Units 30*a* to 30*d*)

Each of the indoor units 30*a* to 30*d* are provided in an indoor space that is a space in a structure, such as a living room, for example, at a position where each indoor unit can supply cooling air or heating air. Thereby, each of the indoor units 30*a* to 30*d* supplies cooling air or heating air to the indoor space, that is, an air-conditioned space. Each of the indoor units 30*a* to 30*d* is connected to a remote control unit (not illustrated) wirelessly or by signal lines, and when a user operates the remote control unit, a predetermined signal is transmitted to each of the indoor units 30*a* to 30*d*. Each of the indoor units 30*a* to 30*d* includes a load-side heat exchanger 31 and an expansion unit 32.

The load-side heat exchanger 31 transfers heat between a load-side heat medium such as air supplied from an air-sending device (not illustrated) such as a fan and the refrigerant, thereby generating cooling air or heating air to be supplied to the indoor space. The load-side heat exchanger 31 is connected to the relay device 20 by the refrigerant pipe 5*a*. The expansion unit 32 is, for example, an electronic expansion valve whose opening degree can be changed, and expands the refrigerant to reduce the pressure thereof. In the cooling operation, the expansion unit 32 expands the refrigerant to reduce the pressure thereof, and supplies the refrigerant to the load-side heat exchanger 31. In the heating operation, the expansion unit 32 expands the refrigerant to reduce the pressure thereof, and supplies the refrigerant to the relay device 20.

Each of the indoor units 30*a* to 30*d* is also provided with a first load temperature sensor 43, a second load temperature sensor 44, and an air temperature sensor 45. The first load temperature sensor 43 is provided between the load-side heat exchanger 31 and the expansion unit 32, and detects the temperature of the refrigerant that flows between the load-side heat exchanger 31 and the expansion unit 32. The second load temperature sensor 44 is provided between the load-side heat exchanger 31 and the relay device 20, and detects the temperature of the refrigerant that flows between the load-side heat exchanger 31 and the relay device 20. The air temperature sensor 45 detects the temperature of the indoor air that is a load heat medium.

(Relay Device 20)

The relay device 20 includes a housing that is separate from those of the heat source apparatus 1 and the indoor units 30*a* to 30*d*, and can be installed at a position other than outdoor space and the indoor space. The relay device 20 includes a gas-liquid separator 21, a first expansion device 22, a second expansion device 23, and second flow switching devices 24*a*, 24*b*, 24*s*, and 24*d*. The relay device 20 is connected to the heat source apparatus 1 by the high-pressure pipe 4*a* and the low-pressure pipe 4*b*, and is connected to each of the indoor units 30*a* to 30*d* by associated refrigerant pipes 5*a* and 5*b*. The relay device 20 distributes the cooling energy or heating energy supplied from the heat source apparatus 1 among the indoor units 30*a* to 30*d*.

The gas-liquid separator 21 separates the high-pressure two-phase gas-liquid refrigerant supplied from the heat source apparatus 1 into liquid refrigerant and gas refrigerant. The gas-liquid separator 21 is provided at an inlet of the relay device 20, and is connected to the heat source apparatus 1 by the high-pressure pipe 4*a*. An upper portion of the gas-liquid separator 21 is connected to a gas pipe 21*a*, and a lower portion of the gas-liquid separator 21 is connected to a liquid pipe 21*b*. Of the liquid refrigerant and the gas refrigerant that are separated from each other by the gas-liquid separator 21, the liquid refrigerant flows from the liquid pipe 21*b* to the indoor units 30*a* to 30*d* via the second flow switching devices 24*a*, 24*b*, 24*c*, and 24*d*. Thereby, cooling energy is supplied to the indoor units 30*a* to 30*d*. On the other hand, the gas refrigerant flows from the gas pipe 21*a* to the indoor units 30*a* to 30*d* via the second flow switching devices 24*a*, 24*b*, 24*c*, and 24*d*. Thereby, heating energy is supplied to the indoor units 30*a* to 30*d*.

The first expansion device 22 has functions corresponding to those of a pressure reducing valve and an open/close valve, and is, for example, an electronic expansion valve whose opening degree can be changed. The first expansion device 22 is provided at the liquid pipe 21*b*. The first expansion device 22 reduces the pressure of the liquid refrigerant to a target pressure, and is opened/closed to allow the liquid refrigerant to flow through a flow passage. The second expansion device 23 has functions corresponding to those of a pressure reducing valve and an open/close valve, and is, for example, an electronic expansion valve whose opening degree can be changed. The second expansion device 23 is provided between the low-pressure pipe 4*b* on the outlet side of the relay device 20 connected to the low-pressure pipe 4*b* and the pipe connected to the outlet side of the first expansion device 22. In the heating only operation, the second expansion device 23 is opened to allow the refrigerant to flow through a flow passage as a bypass passage, and in the heating main operation, the opening degree of the second expansion device 23 is regulated in accordance with the load of the load side, to thereby regulate the flow rate of refrigerant that flows in the bypass passage.

Each of the second flow switching devices 24*a*, 24*b*, 24*c*, and 24*d* changes the flow passage in a switching manner in accordance with the operation mode of an associated one of the indoor units 30*a* to 30*d*, and the number of the second flow switching devices 24*a*, 24*b*, 24*c*, and 24*d* is equal to that of the indoor units 30*a* to 30*d*; that is, second flow switching devices the number of which is equal to that of indoor units installed are provided. The second flow switching devices 24*a*, 24*b*, 24*c*, and 24*d* each include a first open/close valve device 25*a*, a second open/close device 25*b*, a fifth check valve 26*a*, and a sixth check valve 26*b*. The first open/close device 25*a* and the second open/close device 25*b* are connected to an associated refrigerant pipe 5*a* connected to the gas pipe 21*a*, the low-pressure pipe 4*b*, and the heat-source-side heat exchanger 12. The fifth check valve 26*a* and the sixth check valve 26*b* are connected to the associated refrigerant pipe 5*b* connected to the liquid pipe 21*b* and the expansion unit 32. It should be noted that although Embodiment 1 is described above by referring to by way of example the case where the second flow switching devices 24*a*, 24*b*, 24*c*, and 24*d* each include the fifth check valve 26*a*, the sixth check valve 26*b*, the first open/close device 25*a*, and the second open/close device 25*b*, they may be each, for example, a four-way valve.

The first open/close device 25*a* is, for example, a solenoid valve, and is provided between the gas pipe 21*a* and the refrigerant pipe 5*a*. The first open/close device 25*a* is opened when the associated one of the indoor units 30*a* to 30*d* performs the heating operation, and is closed when the associated one of the indoor units 30*a* to 30*d* performs the cooling operation. The second open/close device 25*b* is, for example, a solenoid valve, and is provided between an associated refrigerant pipe 5*b* and the low-pressure pipe 4*b*. The second open/close device 25*b* is opened when the associated one of the indoor units 30*a* to 30*d* performs the cooling operation, and is closed when the associated one of the indoor units 30*a* to 30*d* performs the heating operation. The first open/close device 25*a* and the second open/close device 25*b* are connected parallel to each other.

One end of the fifth check valve 26*a* is connected to the refrigerant pipe 5*b*, and the other end of the fifth check valve 26*a* is connected to the first expansion device 22 and the second expansion device 23. The fifth check valve 26*a* allows the refrigerant to flow from the first expansion device 22 to the associated one of the indoor units 30*a* to 30*d*. Thereby, when the associated one of the indoor units 30*a* to 30*d* is in the cooling operation, refrigerant passes through the fifth check valve 26*a* to flow into the associated one of the indoor units 30*a* to 30*d*. One end of the sixth check valve 26*b* is connected to the refrigerant pipe 5*b*, and the other end of the sixth check valve 26*b* is connected to the first expansion device 22 and the second expansion device 23. The sixth check valve 26*b* allows the refrigerant to flow from the refrigerant pipe 5*b* to the second expansion device 23. Thereby, when the associated one of the indoor units 30*a* to 30*d* is in the heating operation, the refrigerant passes through the sixth check valve 26*b* and flows into the second expansion device 23.

The relay device 20 also includes a first pressure sensor 41 and a second pressure sensor 42. The first pressure sensor 41 detects the pressure of the refrigerant that flows between the gas-liquid separator 21 and the first expansion device 22. The second pressure sensor 42 detects the pressure of the refrigerant that has passed through the first expansion device 22. It should be noted that the first pressure sensor 41, the first load temperature sensors 43, and the second load temperature sensors 44 operate as refrigerant temperature sensors that detect the temperature of the refrigerant having flowed through the respective load-side heat exchangers 31.

(Refrigerant)

The refrigerant for use in the air-conditioning apparatus 100 may be HFC refrigerant such as R410A, R407C, or R404A, or HCFC refrigerant such as R22 or R134a, or natural refrigerant such as hydrocarbon or helium.

(Heat Medium Circuit 100B)

In the heat medium circuit 100B, a pump 61, a flow control valve 60, and the heat-source-side heat exchanger 12 are connected by heat medium pipes 62, and a heat-source heat medium flows. The pump 61 transfers the heat-source-side heat medium to the heat-source-side heat exchanger 12. Normally, the pump 61 is driven by a predetermined set output. The opening degree of the flow control valve 60 can be regulated, and the flow control valve 6 regulates the flow rate of the heat-source heat medium that is circulated in the heat medium circuit 100B. It should be noted that the minimum opening degree of the flow control valve 60, which is set as that of a component, is the opening degree of the flow control valve 60 at the time when the flow control valve 60 is completely closed, and at this time, the flow control valve 60 blocks the entire heat-source heat medium that flows to the flow control valve 60. It should be noted that the minimum opening degree of the flow control valve 60, which is set as that of the component, may be an opening degree of the flow control valve 60 at the time when the flow control valve 60 is slightly opened, not in a completely closed state. In this case, by using a two-way valve along with the flow control valve 60, it is possible to block the flow of the heat-source heat medium as in the case where the flow control valve 60 is completely closed. Further, the maximum opening degree of the flow control valve 60, which is set as that of the component, is an opening degree of the flow control valve 60 at the time when the flow control valve 60 is fully opened, and the flow control valve 60 allows the entire heat-source heat medium that flows in the flow control valve 60 to flow out thereof as it is.

The heat-source-side heat exchanger 12 is a plate-type heat exchanger that transfers heat between the refrigerant that flows in the plate and the heat-source heat medium that flows in the plate. One side of the heat-source-side heat exchanger 12 is connected to the flow control valve 60, and the other side of the heat-source-side heat exchanger 12 is connected to the suction side of the pump 61. The heat-source-side heat exchanger 12 operates as a radiator in the cooling operation, thereby heating the heat-source heat medium. The heat-source-side heat exchanger 12 operates as an evaporator in the heating operation, thereby cooling the heat-source heat medium. It should be noted that the flow rate of the heat-source heat medium that is allowed to flow in the heat-source-side heat exchanger 12 is set in advance. In Embodiment 1, this flow rate may be referred to as a range of the flow-rate capacity of the heat source apparatus 1.

The heat medium circuit 100B includes a flow rate sensor 63 and the heat medium temperature sensor 17 provided at the heat source apparatus 1. The heat medium temperature sensor 17 detects the temperature of the heat-source heat medium that flows in the heat medium circuit 100B. The flow rate sensor 63 is provided at the heat medium pipe 62, and detects the flow rate of the heat-source heat medium that flows in the heat medium circuit 100B. Although Embodiment 1 is described by referring to the case where the flow rate sensor 63 is a flowmeter that directly measures the flow rate of the heat-source heat medium, the flow rate sensor 63 may be two pressure gauges. In that case, the pressure gauges detect the pressures of the heat-source heat medium that flows to the inlet side and the outlet side of the heat-source-side heat exchanger 12. Then, based on the difference between the pressures measured by the two pressure gauges, the controller 50 estimates the flow rate of the heat-source heat medium. In Embodiment 1, although one heat source apparatus 1 and one pump 61 are connected to each other, this is not limitative. A plurality of heat source apparatuses may be connected to one pump 61.

(Heat Medium)

The heat-source heat medium for use in the heat medium circuit 100B is, for example, water. However, brine may also be used. In the case where the heat-source heat medium is water, in the heat-source-side heat exchanger 12, the refrigerant and the water exchange heat with each other, and cooling energy or heating energy is supplied to the indoor units 30*a* to 30*d*. That is, the air-conditioning apparatus 100 according to Embodiment 1 is a water-cooled air-conditioning apparatus 100.

(Controller 50)

Figure 2:
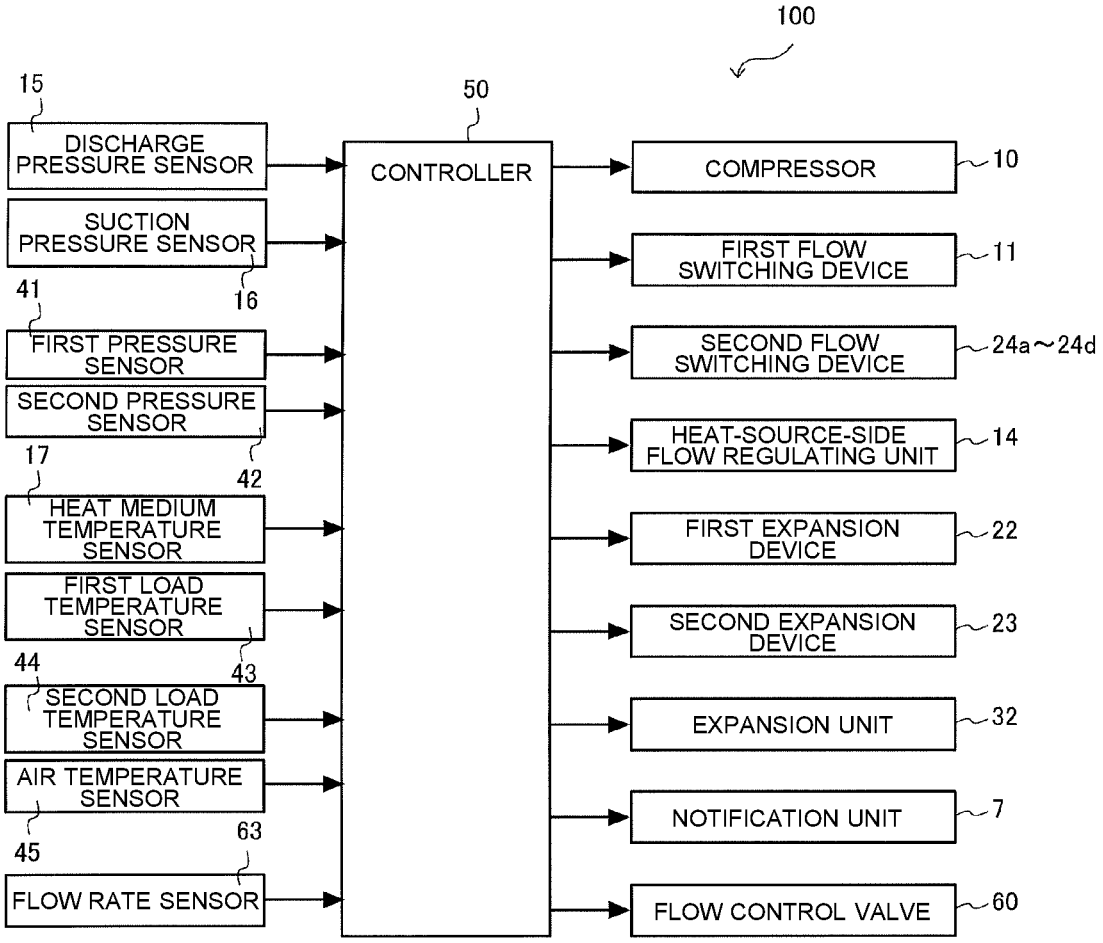
FIG. 2 is a hardware configuration diagram of the air-conditioning apparatus 100 according to Embodiment 1 of the present invention.

FIG. 2 is a hardware configuration diagram of the air-conditioning apparatus 100 according to Embodiment 1 of the present invention. As illustrated in FIG. 2, the controller 50 is, for example, a microcomputer, and controls the operation of the air-conditioning apparatus 100 based on detection information obtained by detection by the sensors and an instruction signal transmitted from a remote control unit. It should be noted that Embodiment 1 is described by referring to by way of example the case where the controller 50 is provided in the heat source apparatus 1; however, the controller 50 may be provided in any of the indoor units 30*a* to 30*d*. Furthermore, the controller 50 may include a housing separate from those of the heat source apparatus 1 and the indoor units 30*a* to 30*d*.

The controller 50 controls the opening degree of the first expansion device 22 such that the difference between the pressure detected by the first pressure sensor 41 and the pressure detected by the second pressure sensor 42 reaches a target pressure difference. The target pressure difference is, for example, 0.3 MPa. In the cooling operation, the controller 50 controls the opening degree of the expansion unit 32 such that the degree of superheat obtained as the difference between the temperature detected by the first load temperature sensor 43 and the temperature detected by the second load temperature sensor 44 becomes constant. In the heating operation, the controller 50 controls the opening degree of the expansion unit 32 such that the degree of subcooling obtained as the difference between a saturation temperature into which the pressure detected by the first pressure sensor 41 is converted and the temperature detected by the first load temperature sensor 43 becomes constant.

Furthermore, the controller 50 controls the amount of compression by the compressor 10 such that the pressure detected by the discharge pressure sensor 15 does not fall below the target temperature. The controller 50 also controls the amount of compression by the compressor 10 such that the pressure detected by the suction pressure sensor 16 falls within the range of the target pressure. When the temperature detected by the heat medium temperature sensor 17 does not fall within the range of the target temperature, the controller 50 stops the operation of the air-conditioning apparatus 100 to prevent the apparatus from being damaged.

It should be noted that the air-conditioning apparatus 100 may include a notification unit 7. The notification unit 7 is a display devices, a speaker, or other devices. Based on detection information obtained by the sensors and an instruction signal transmitted from the remote control unit, the controller 50 causes the detection information or the contents of the instruction to be displayed on the display device. Alternatively, based on the detection information obtained by the sensors and the instruction signal transmitted from the remote control unit, the controller 50 allows the speaker to output a predetermined sound. Furthermore, the controller 50 acquires information from each of the indoor units 30*a* to 30*d* that receives an instruction from the remote control unit or other devices, and controls each of the indoor units 30*a* to 30*d* to perform the cooling operation or the heating operation. That is, in the air-conditioning apparatus 100, the indoor units 30*a* to 30*d* can perform the same operation or different operations.

The controller 50 controls the opening degree of the flow control valve 60 in accordance with the air-conditioning load such that the flow rate of the heat-source heat medium that flows in the heat medium circuit 100B falls within the range of the flow-rate capacity of the heat source apparatus 1. For example, when the air conditioning load is great, the controller 50 increases the opening degree of the flow control valve 60 to increase the flow rate of the heat medium. By contrast, when the air conditioning load is small, the controller 50 decreases the opening degree of the flow control valve 60 to decrease the flow rate of the heat-source heat medium. Thereby, it is possible to use a required amount of heat-source heat medium when it is necessary to use it.

Figure 3:
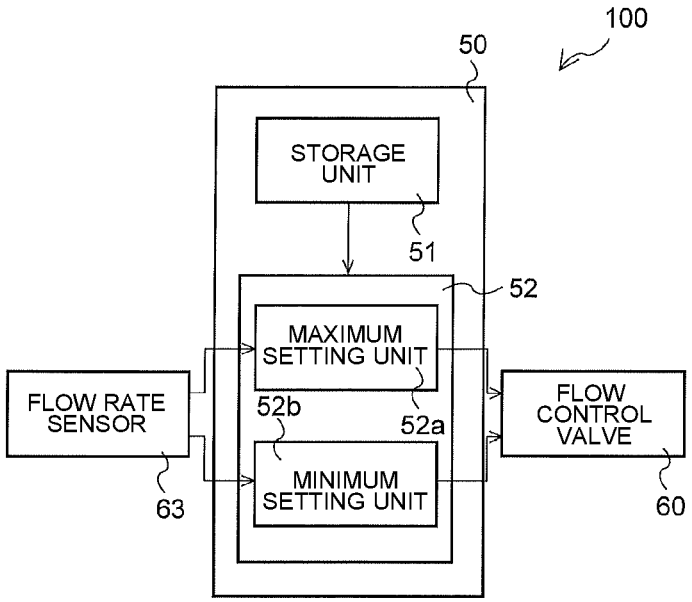
FIG. 3 is a block diagram of a controller 50 of the air-conditioning apparatus 100 according to Embodiment 1 of the present invention.

FIG. 3 is a block diagram of the controller 50 of the air-conditioning apparatus 100 according to Embodiment 1 of the present invention. As illustrated in FIG. 3, the controller 50 includes a storage unit 51 and an opening-degree setting unit 52. The storage unit 51 is, for example, a memory, and stores data regarding a defined maximum flow rate Fmax and a defined minimum flow rate Fmin of the heat-source heat medium that flows in the heat medium circuit 100B. In the air-conditioning apparatus 100, since the flow rate of the heat-source heat medium that can be made to flow to the heat-source-side heat exchanger 12 is determined in advance, a flow rate range between a maximum flow rate and a minimum flow rate of the heat-source heat medium that flows in the heat medium circuit 100B is set.

The defined maximum flow rate Fmax is a maximum flow rate of the heat-source heat medium that can be made to flow to the heat-source-side heat exchanger 12. The defined minimum flow rate Fmin is a minimum flow rate of the heat-source heat medium that is required when the heat-source heat medium flows to the heat-source-side heat exchanger 12. It should be noted that the defined maximum flow rate Fmax and the defined minimum flow rate Fmin are set by a changeover switch (not illustrated) of the controller 50 or by an external input to the controller 50. The external input means, for example, inputting the defined maximum flow rate Fmax or the defined minimum flow rate Fmin to the storage unit 51 using a terminal or other devices.

The opening-degree setting unit 52 sets the maximum opening degree and the minimum opening degree of the flow control valve 60 based on the flow rate detected by the flow rate sensor 63, the defined maximum flow rate Fmax stored in the storage unit 51, and the defined minimum flow rate Fmin stored in the storage unit 51. The maximum opening degree is not the maximum opening degree of the flow control valve 60, which is set as that of the component; that is, the maximum opening degree is the opening degree corresponding to the defined maximum flow rate Fmax that is an upper limit value of the range of the flow-rate capacity of the heat source apparatus 1. The minimum opening degree is not the minimum opening degree of the flow control valve 60, which is set as that of the component; that is, the minimum opening degree is the opening degree corresponding to the defined minimum flow rate Fmin that is a lower limit value of the range of the flow-rate capacity of the heat source apparatus 1. It should be noted that the opening-degree setting unit 52 includes a maximum setting unit 52*a* and a minimum setting unit 52*b*.

Figure 4:
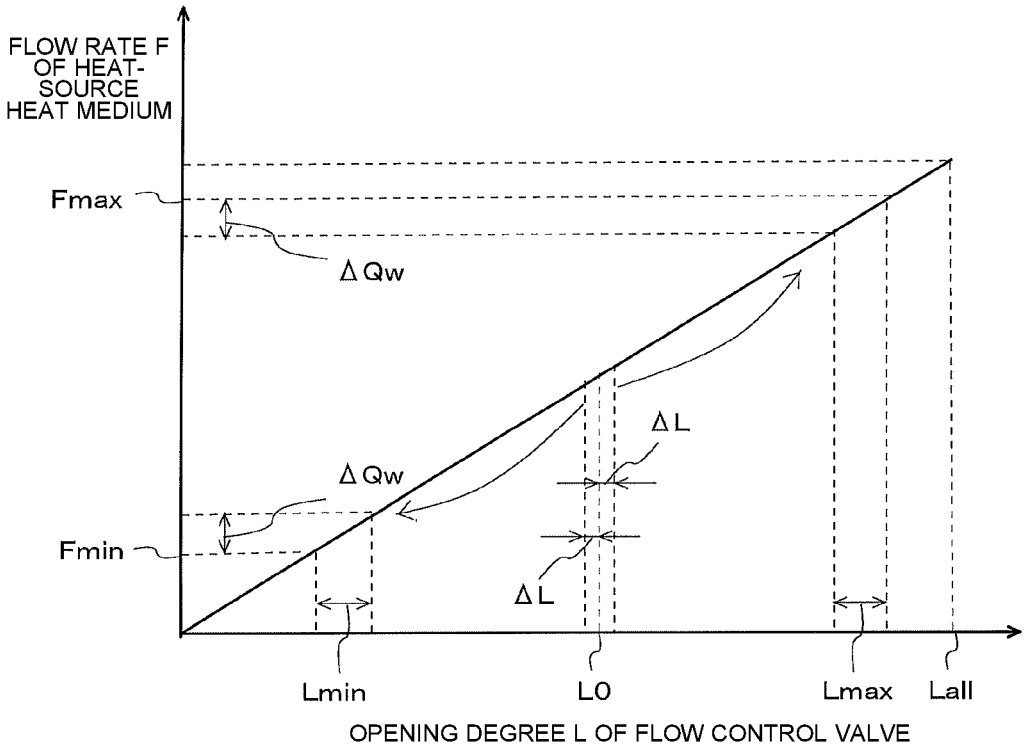
FIG. 4 is a graph indicating a relationship between the opening degree of a flow control valve 60 and the flow rate of a heat-source heat medium in Embodiment 1.

FIG. 4 is a graph indicating a relationship between the opening degree of the flow control valve 60 and the flow rate of the heat-source heat medium in Embodiment 1 of the present invention. In FIG. 4, the horizontal axis indicates an opening degree L of the flow control valve 60, and the vertical axis indicates a flow rate F of the heat-source heat medium. In the case where the pump 61 is driven by a set output, when the flow rate detected by the flow rate sensor 63 exceeds the defined maximum flow rate Fmax, the maximum setting unit 52*a* decreases the opening degree of the flow control valve 60 by a regulation opening degree ΔL. By contrast, in the case where the pump 61 is driven by the set output, when the flow rate detected by the flow rate sensor 63 falls below a value obtained by subtracting an allowable flow rate ΔQw from the defined maximum flow rate Fmax, the maximum setting unit 52*a* increases the opening degree of the flow control valve 60 by the regulation opening degree ΔL. Thereby, the maximum setting unit 52*a* sets the maximum opening degree. It should be noted that the allowable flow rate ΔQw is a parameter that determines the range of the defined maximum flow rate Fmax that is the upper limit value of the range of the flow-rate capacity of the heat source apparatus 1. The regulation opening degree ΔL is a value by which the opening degree of the flow control valve 60 is regulated. The opening degree corresponding to the allowable flow rate ΔQw is greater than the regulation opening degree ΔL. Thereby, it is possible to prevent the flow control valve 60 from being regulated by more than the regulation value when it is regulated.

As illustrated in FIG. 4, the maximum setting unit 52*a* sets the opening degree of the flow control valve 60 to a predetermined initial opening degree L0. Then, when the flow rate detected by the flow rate sensor 63 exceeds the defined maximum flow rate Fmax, the maximum setting unit 52*a* decreases the initial opening degree L0 of the flow control valve 60 by the regulation opening degree ΔL. Then, the opening degree L is repeatedly decreased by the regulation opening degree ΔL until the detected flow rate detected by the flow rate sensor 63 falls below the defined maximum flow rate Fmax after a predetermined time elapses.

By contrast, when the detected flow rate detected by the flow rate sensor 63 falls below the value obtained by subtracting the allowable flow rate ΔQw from the defined maximum flow rate Fmax, the maximum setting unit 52*a* increases the opening degree L of the flow control valve 60 by the regulation opening degree ΔL. Then, the maximum setting unit 52*a* repeatedly increases the opening degree L of the flow control valve 60 by the regulation opening degree ΔL until the detected flow rate detected by the flow rate sensor 63 exceeds the value obtained by subtracting the allowable flow rate ΔQw from the defined maximum flow rate Fmax after the predetermined time elapses. It should be noted that the regulation opening degree ΔL may be changed between the opening degree which is set until the detected flow rate falls below the defined maximum flow rate Fmax and the opening degree which is set until the detected flow rate exceeds the value obtained by subtracting the allowable flow rate ΔQw from the defined maximum flow rate Fmax.

When the flow rate detected by the flow rate sensor 63 satisfies a requirement in which the detected flow rate is lower than or equal to the defined maximum flow rate Fmax and higher than or equal to the value obtained by subtracting the allowable flow rate ΔQw from the defined maximum flow rate Fmax, the maximum setting unit 52*a* sets the opening degree L at that time as the maximum opening degree Lmax. It should be noted that the maximum opening degree Lmax is smaller than the maximum opening degree Lall.

In the case where the pump 61 is driven by the set output, when the flow rate detected by the flow rate sensor 63 falls below the defined minimum flow rate Fmin, the minimum setting unit 52*b* increases the opening degree of the flow control valve 60 by the regulation opening degree ΔL. By contrast, in the case where the pump 61 is driven by the set output, when the flow rate detected by the flow rate sensor 63 exceeds the defined minimum flow rate Fmin, the minimum setting unit 52*b* decreases the opening degree of the flow control valve 60 by the regulation opening degree ΔL. Thereby, the minimum setting unit 52*b* sets the minimum opening degree.

When the flow rate detected by the flow rate sensor 63 falls below the defined minimum flow rate Fmin, the minimum setting unit 52*b* increases the opening degree L of the flow control valve 60 by the regulation opening degree ΔL. Then, the minimum setting unit 52*b* repeatedly increases the opening degree L by the regulation opening degree ΔL until the flow rate detected by the flow rate sensor 63 exceeds the minimum flow rate Fmin after the predetermined time elapses. By contrast, when the flow rate detected by the flow rate sensor 63 exceeds the value obtained by adding the allowable flow rate ΔQw to the defined minimum flow rate Fmin, the minimum setting unit 52*b* decreases the opening degree of the flow control valve 60 by the regulation opening degree ΔL. Then, the minimum setting unit 52*b* repeatedly decreases the opening degree L by the regulation opening degree ΔL until the flow rate detected by the flow rate sensor 63 falls below the value obtained by adding the allowable flow rate ΔQw to the defined minimum flow rate Fmin after the predetermined time elapses. It should be noted that the regulation opening degree ΔL may be changed between the opening degree which is set until the detected value exceeds the defined minimum flow rate Fmin and the opening degree which is set until the detected value falls below the value obtained by adding the allowable flow rate ΔQw to the defined minimum flow rate Fmin. When the flow rate detected by the flow rate sensor 63 satisfies a requirement in which the detected flow rate is higher than or equal to the defined minimum flow rate Fmin and lower than or equal to the value obtained by adding the allowable flow rate ΔQw to the defined minimum flow rate Fmin, the minimum setting unit 52*b* sets the opening degree L at that time as the minimum opening degree Lmin.

The opening degree of the flow control valve 60 that is changed in accordance with the air-conditioning load is regulated within the range between the set maximum opening degree and the set minimum opening degree. Therefore, the flow rate of the heat-source heat medium that is circulated in the heat medium circuit 100B falls within the range of the flow-rate capacity of the heat source apparatus 1.

As described above, the opening-degree setting unit 52 sets the maximum opening degree and the minimum opening degree of the flow control valve 60 based on the defined maximum flow rate Fmax and the defined minimum flow rate Fmin that are both stored as data in the storage unit 51. Therefore, it is possible to set the maximum opening degree and the minimum opening degree of the flow control valve 60 regardless of whether the compressor 10 is in operation or not. Thus, the opening-degree setting unit 52 of Embodiment 1 can set the maximum opening degree and the minimum opening degree of the flow control valve 60 even when the compressor 10 is not in operation.

Next, the operations in the operation modes of the air-conditioning apparatus 100 will be described. As described above, the air-conditioning apparatus 100 can perform the cooling only operation, the heating only operation, the cooling main operation, and the heating main operation as operation modes. The following description is made by referring to by way of example the case where the indoor units 30*a* and 30*b* are in operation, and no air-conditioning load is applied to the indoor units 30*c* and 30*d*, and it is not necessary to cause the refrigerant to flow in the indoor units 30*c* and 30*d*. Therefore, the expansion units 32 provided in the indoor units 30*c* and 30*d* are closed. It should be noted that the indoor units 30*c* and 30*d* may be set such that when an air-conditioning load is applied, the expansion units 32 may be opened to allow circulation of refrigerant.

(Cooling Only Operation)

Figure 5:
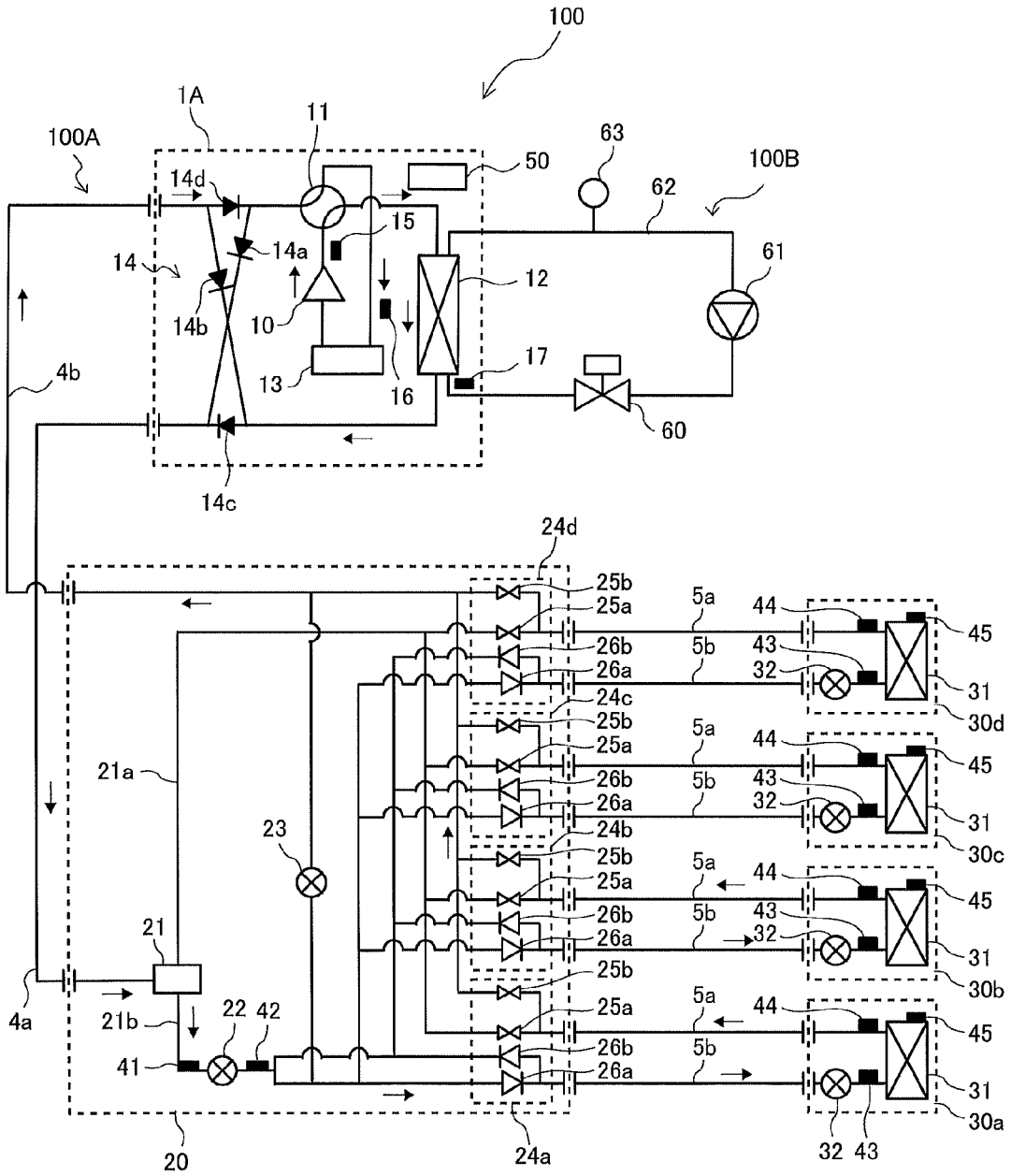
FIG. 5 is a circuit diagram indicating the flow of refrigerant in the air-conditioning apparatus 100 during a cooling only operation in Embodiment 1 of the present invention.

FIG. 5 is a circuit diagram indicating the flow of refrigerant during the cooling only operation of the air-conditioning apparatus 100 according to Embodiment 1 of the present invention. The cooling only operation will be described. In the air-conditioning apparatus 100, the indoor units 30*a* and 30*b* are in the cooling operation and the indoor units 30*c* and 30*d* are in the stopped state. The first flow switching device 11 switches the flow passage to cause the refrigerant discharged from the compressor 10 to flow to the heat-source-side heat exchanger 12. As illustrated in FIG. 5, low-temperature, low-pressure refrigerant is sucked into the compressor 10, and high-temperature, high-pressure gas refrigerant discharged from the compressor 10 passes through the first flow switching device 11 and flows into the heat-source-side heat exchanger 12 that operates as a radiator.

The refrigerant that has flowed into the heat-source-side heat exchanger 12 transfers heat to the heat-source heat medium in the heat-source-side heat exchanger 12 and is liquefied. The liquefied high-pressure liquid refrigerant flows out of the heat source apparatus 1 through the third check valve 14*c*, and flows into the relay device 20 through the high-pressure pipe 4*a*. The high-pressure liquid refrigerant that has flowed into the relay device 20 flows into the indoor units 30*a* and 30*b* through the gas-liquid separator 21, the first expansion device 22, the fifth check valves 26*a* of the second flow switching devices 24*a* and 24*b*, and the refrigerant pipes 5*b*.

Then, the refrigerant that has flowed into each of the indoor units 30*a* and 30*b* is expanded by the expansion unit 32 which is controlled such that the superheat at the outlet side of the load-side heat exchanger 31 becomes constant, and becomes low-temperature, low-pressure two-phase gas-liquid refrigerant. The two-phase gas-liquid refrigerant flows into the load-side heat exchanger 31 that operates as an evaporator, and receives heat from the indoor air that is a load heat medium to thereby cool the indoor air, and becomes low-temperature, low-pressure gas refrigerant. At that time, the indoor space is cooled. The gas refrigerant that has flowed out of the indoor units 30*a* and 30*b* flows out of the relay device 20 through the refrigerant pipes 5*a* and the second open/close devices 25*b* of the second flow switching devices 24*a* and 24*b*. The refrigerant that has flowed out of the relay device 20 passes through the low-pressure pipe 4*b*, and re-flows into the heat source apparatus 1. The refrigerant that has flowed into the heat source apparatus 1 passes through a fourth check valve 14*d* and is re-sucked into the compressor 10 via the accumulator 13 of the flow switching device 11.

Next, the flow of heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant and is heated. The heated heat-source heat medium is re-sucked into the pump 61.

(Heating Only Operation)

Figure 6:
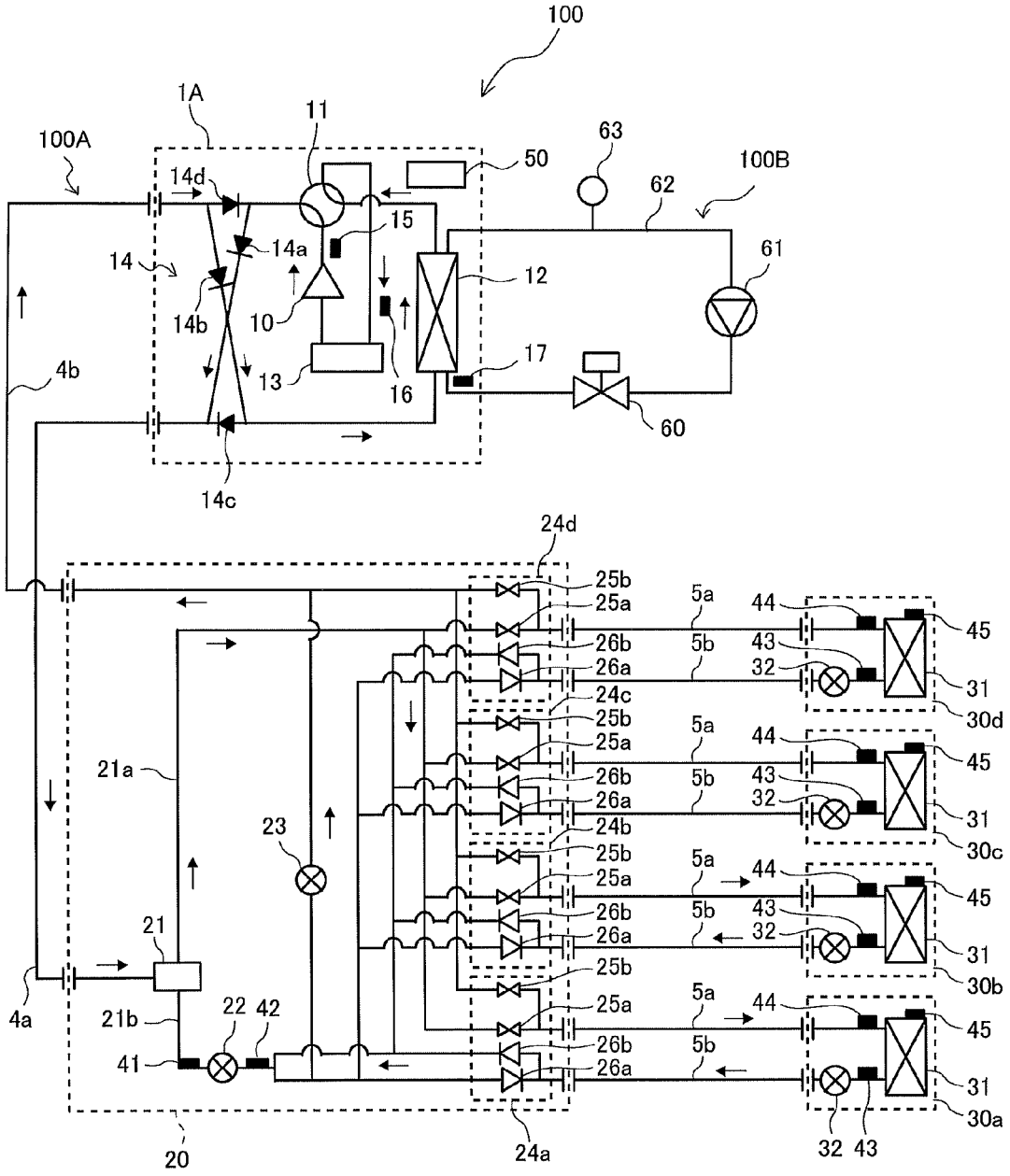
FIG. 6 is a circuit diagram indicating the flow of refrigerant in the air-conditioning apparatus 100 during a heating only operation in Embodiment 1 of the present invention.

FIG. 6 is a circuit diagram indicating the flow of refrigerant during the heating only operation of the air-conditioning apparatus 100 according to Embodiment 1 of the present invention. Next, the heating only operation will be described. In the air-conditioning apparatus 100, the indoor units 30*a* and 30*b* are in the heating operation and the indoor units 30*c* and 30*d* are in the stopped state. The first flow switching device 11 switches the flow passage such that the refrigerant discharged from the compressor 10 flows to the relay device 20 without passing through the heat-source-side heat exchanger 12. As illustrated in FIG. 6, low-temperature, low-pressure refrigerant is sucked into the compressor 10, and high-temperature, high-pressure gas refrigerant discharged from the compressor 10 passes through the first flow switching device 11 and the first check valve 14*a*, and flows into the relay device 20 through the high-pressure pipe 4*a*. The high-temperature, high-pressure gas refrigerant that has flowed into the relay device 20 flows into the indoor units 30*a* and 30*b* through the gas-liquid separator 21, the first open/close devices 25*a* of the second flow switching devices 24*a* and 24*b*, and the refrigerant pipes 5*b*.

The high-temperature, high-pressure gas refrigerant that has flowed into each of the indoor units 30*a* and 30*b* flows into the load-side heat exchanger 31 that operates as a condenser, and transfers heat to the indoor air that is a load heat medium to thereby heat the indoor air, and becomes liquid refrigerant. At that time, the indoor space is heated. The liquid refrigerant that has flowed out of the load-side heat exchanger 31 is expanded by the expansion unit 32 which is controlled such that the subcooling on the outlet side of the load-side heat exchanger 31 becomes constant, and becomes low-temperature, low-pressure two-phase gas-liquid refrigerant. Then, the refrigerant passes through the refrigerant pipe 5*b*, the sixth check valve 26*b*, and the second expansion device 23, and flows out of the relay device 20.

The refrigerant that has flowed out of the relay device 20 passes through the low-pressure pipe 4*b*, and re-flows into the heat source apparatus 1. The refrigerant that has flowed into the heat source apparatus 1 passes through the second check valve 14*b*, and flows into the heat-source-side heat exchanger 12 that operates as an evaporator. The refrigerant that has flowed into the heat-source-side heat exchanger 12 receives heat from the heat-source heat medium in the heat-source-side heat exchanger 12 and becomes low-temperature, low-pressure gas refrigerant. The low-temperature, low-pressure gas refrigerant that has flowed out of the heat-source-side heat exchanger 12 is re-sucked into the compressor 10 via the flow switching device 11 and the accumulator 13.

Next, the flow of heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant and is cooled. The cooled heat-source heat medium is re-sucked into the pump 61.

(Cooling Main Operation)

Figure 7:
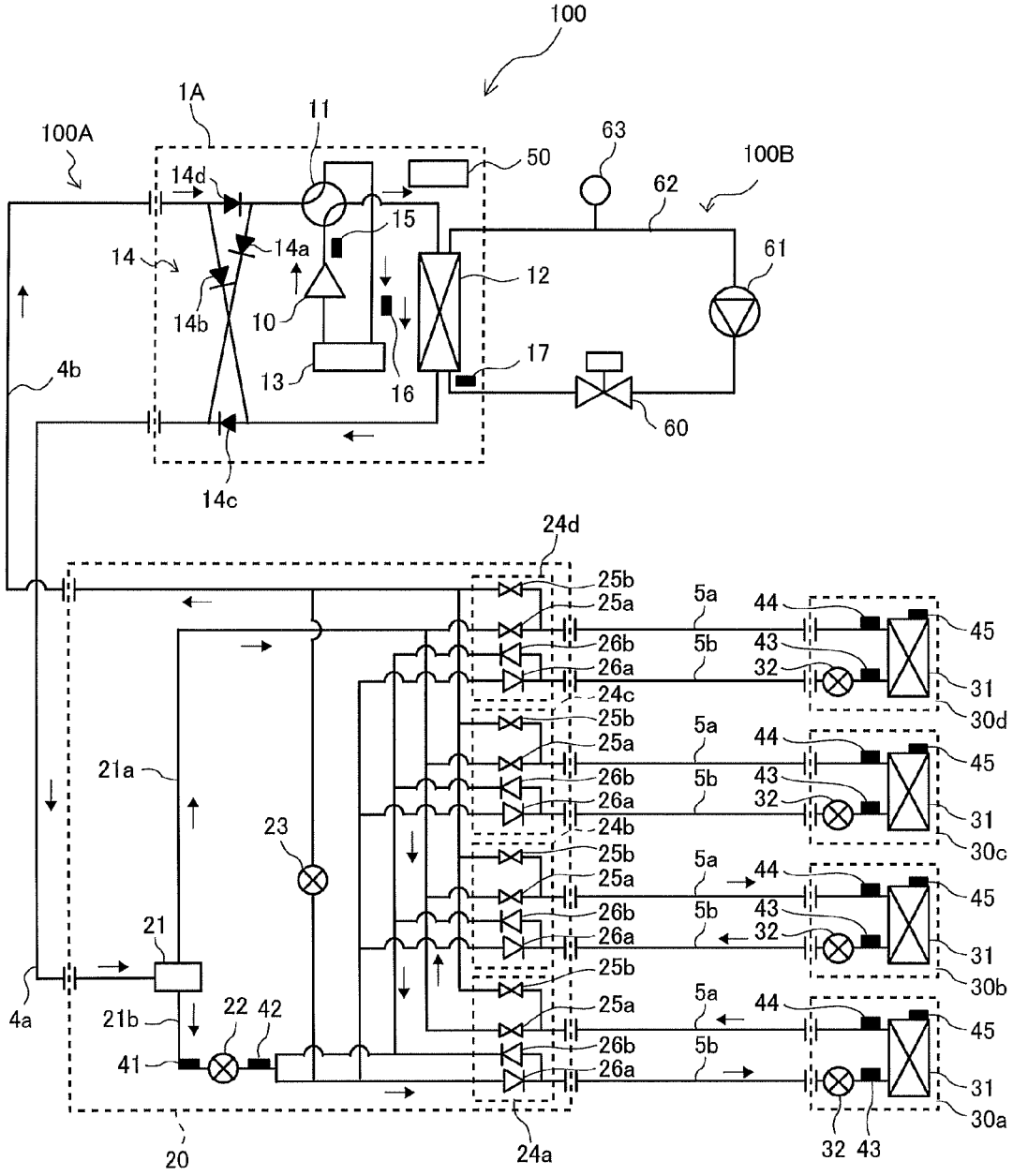
FIG. 7 is a circuit diagram indicating the flow of refrigerant in the air-conditioning apparatus 100 during a cooling main operation in Embodiment 1 of the present invention.

FIG. 7 is a circuit diagram indicating the flow of refrigerant during the cooling main operation of the air-conditioning apparatus 100 according to Embodiment 1 of the present invention. Next, the cooling main operation will be described. In the air-conditioning apparatus 100, the indoor unit 30*a* are in the cooling operation, the indoor unit 30*b* are in the heating operation, and the indoor units 30*c* and 30*d* are in the stopped state. The first flow switching device 11 switches the flow passage such that the refrigerant discharged from the compressor 10 flows to the heat-source-side heat exchanger 12. As illustrated in FIG. 7, low-temperature, low-pressure refrigerant is sucked into the compressor 10, and high-temperature, high-pressure gas refrigerant discharged from the compressor 10 passes through the first flow switching device 11 and flows into the heat-source-side heat exchanger 12 that operates as a radiator. The refrigerant that has flowed into the heat-source-side heat exchanger 12 transfers heat to the heat-source heat medium in the heat-source-side heat exchanger 12, and becomes two-phase gas-liquid refrigerant. The two-phase gas-liquid refrigerant flows out of the heat source apparatus 1 through the third check valve 14*c*, and flows into the relay device 20 through the high-pressure pipe 4*a*. The two-phase gas-liquid refrigerant that has flowed into the relay device 20 is separated into high-pressure gas refrigerant and high-pressure liquid refrigerant at the gas-liquid separator 21.

The high-pressure gas refrigerant which is separated from the high-pressure liquid refrigerant at the gas-liquid separator 21 flows into the indoor unit 30*b* through the gas pipe 21*a*, the first open/close device 25*a* of the second flow switching device 24*b*, and the refrigerant pipe 5*b*. The high-temperature gas refrigerant that has flowed into the indoor unit 30*b* flows into the load-side heat exchanger 31 that operates as a condenser, and transfers heat to the indoor air that is a load heat medium to thereby heat the indoor air, and becomes liquid refrigerant. At that time, the indoor space is heated. The liquid refrigerant that has flowed out of the load-side heat exchanger 31 is expanded by the expansion unit 32 which is controlled such that the subcooling on the outlet side of the load-side heat exchanger 31 becomes constant. Then, the refrigerant passes through the refrigerant pipe 5*b* and the sixth check valve 26*b*, and flows to the outlet side of the first expansion device 22.

By contrast, the high-pressure liquid refrigerant which is separated from the high-pressure gas refrigerant at the gas-liquid separator 21 passes through the liquid pipe 21*b* and is expanded at the first expansion device 22 such that its high pressure is reduced to an intermediate pressure, and joins the refrigerant that has flowed out of the indoor unit 30*b*, to change into an intermediate-pressure liquid refrigerant. It should be noted that the intermediate pressure is a value obtained by subtracting, for example, approximately 0.3 MPa from the high pressure. The intermediate-pressure liquid refrigerant flows into the indoor unit 30*a* via the fifth check valve 26*a* and the refrigerant pipe 5*b*. Then, the refrigerant that has flowed into the indoor unit 30*a* is expanded by the expansion unit 32 which is controlled such that the superheating on the outlet side of the load-side heat exchanger 31 becomes constant, and becomes low-temperature, low-pressure two-phase gas-liquid refrigerant.

The two-phase gas-liquid refrigerant flows into the load-side heat exchanger 31 operates as an evaporator, and receives heat from the indoor air that is a load heat medium to thereby cool the indoor air, and becomes low-temperature, low-pressure gas refrigerant. At that time, the indoor space is cooled. The gas refrigerant that has flowed out of the indoor units 30*a* flows out of the relay device 20 through the refrigerant pipe 5*a* and the second open/close device 25*b* of the second flow switching device 24*a*. The refrigerant that has flowed out of the relay device 20 passes through the low-pressure pipe 4*b*, and re-flows into the heat source apparatus 1. The refrigerant that has flowed into the heat source apparatus 1 passes through a fourth check valve 14*d* and is re-sucked into the compressor 10 via the flow switching device 11 and the accumulator 13.

Next, the flow of the heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant and is heated. The heated heat-source heat medium is re-sucked into the pump 61.

(Heating Main Operation)

Figure 8:
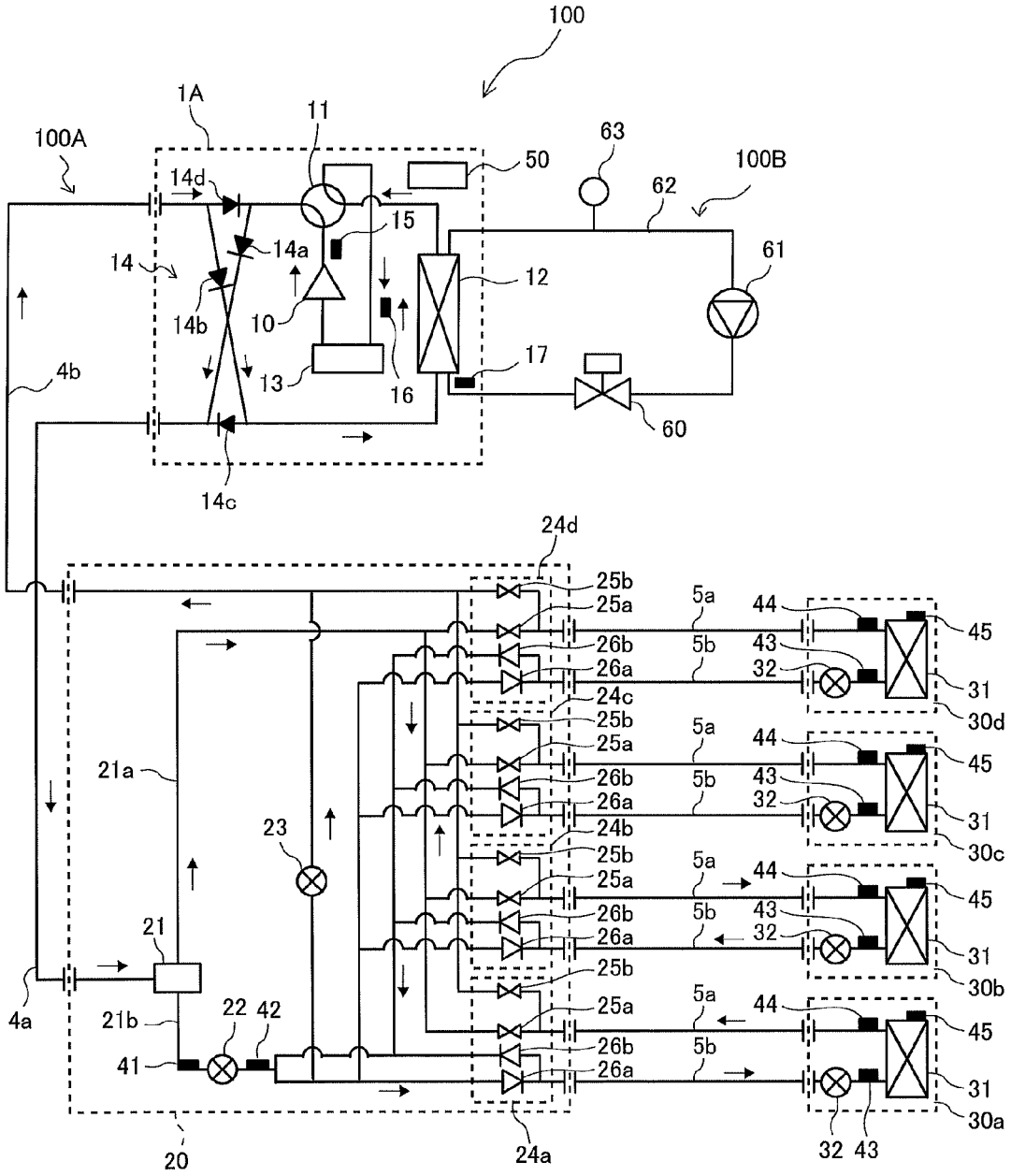
FIG. 8 is a circuit diagram indicating the flow of refrigerant in the air-conditioning apparatus 100 during a heating main operation in Embodiment 1 of the present invention.

FIG. 8 is a circuit diagram indicating the flow of refrigerant during the heating main operation of the air-conditioning apparatus 100 according to Embodiment 1 of the present invention. Next, the heating main operation will be described. In the air-conditioning apparatus 100, the indoor unit 30*a* performs the cooling operation, the indoor unit 30*b* performs the heating operation, and the indoor units 30*c* and 30*d* are in the stopped state. The first flow switching device 11 switches the flow passage such that the refrigerant discharged from the compressor 10 flows to the relay device 20 without passing through the heat-source-side heat exchanger 12. As illustrated in FIG. 8, low-temperature, low-pressure refrigerant is sucked into the compressor 10, and high-temperature, high-pressure gas refrigerant discharged from the compressor 10 passes through the first flow switching device 11 and the first check valve 14*a*, and flows into the relay device 20 through the high-pressure pipe 4*a*. The high-temperature, high-pressure gas refrigerant that has flowed into the relay device 20 flows into the indoor unit 30*b* through the gas-liquid separator 21, the gas pipe 21*a*, the first open/close device 25*a* of the second flow switching device 24*b*, and the refrigerant pipe 5*b*.

Then, the high-temperature, high-pressure gas refrigerant that has flowed into the indoor unit 30*b* flows into the load-side heat exchanger 31 that operates as a condenser, and transfers heat to the indoor air that is a load heat medium to thereby heat the indoor air, and becomes liquid refrigerant. At that time, the indoor space is heated. The liquid refrigerant that has flowed out of the load-side heat exchanger 31 is expanded by the expansion unit 32 which is controlled such that the subcooling on the outlet side of the load-side heat exchanger 31 becomes constant, and becomes low-temperature, low-pressure two-phase gas-liquid refrigerant. Then, the refrigerant passes through the refrigerant pipe 5*b* and the sixth check valve 26*b*, and then branches into two refrigerants that flows through two flow passages.

One of the flow passages allows refrigerant to flow into the fifth check valve 26*a* of the second flow switching device 24*a*, and the other is used as a bypass that allows refrigerant to flow into the second expansion device 23.

The refrigerant that has passed through the fifth check valve 26*a* flows into the indoor unit 30*a* via the refrigerant pipe 5*b*. Then, the refrigerant that has flowed into the indoor unit 30*a* is expanded by the expansion unit 32 which is controlled such that the superheating on the outlet side of the load-side heat exchanger 31 becomes constant, and becomes low-temperature, low-pressure two-phase gas-liquid refrigerant. The two-phase gas-liquid refrigerant flows into the load-side heat exchanger 31 that operates as an evaporator, and receives heat from the indoor air that is a load heat medium to thereby cool the indoor air, and becomes low-temperature, low-pressure gas refrigerant. At that time, the indoor space is cooled.

The gas refrigerant that has flowed out of the indoor units 30*a* passes through the refrigerant pipe 5*a* and the second open/close device 25*b* of the second flow switching device 24*a* and joins the refrigerant that has passed through the second expansion device 23, and flows out of the relay device 20. The refrigerant that has flowed out of the relay device 20 passes through the low-pressure pipe 4*b*, and re-flows into the heat source apparatus 1. The refrigerant flowing into the heat source apparatus 1 passes through the second check valve 14*b*, and flows into the heat-source-side heat exchanger 12 that operates as an evaporator. The refrigerant that has flowed into the heat-source-side heat exchanger 12 receives heat from the heat-source heat medium in the heat-source-side heat exchanger 12 and becomes low-temperature, low-pressure gas refrigerant. The low-temperature, low-pressure gas refrigerant that has flowed out of the heat-source-side heat exchanger 12 is re-sucked into the compressor 10 via the flow switching device 11 and the accumulator 13.

Next, the flow of the heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant and is cooled. The cooled heat-source heat medium is re-sucked into the pump 61.

Figure 9:
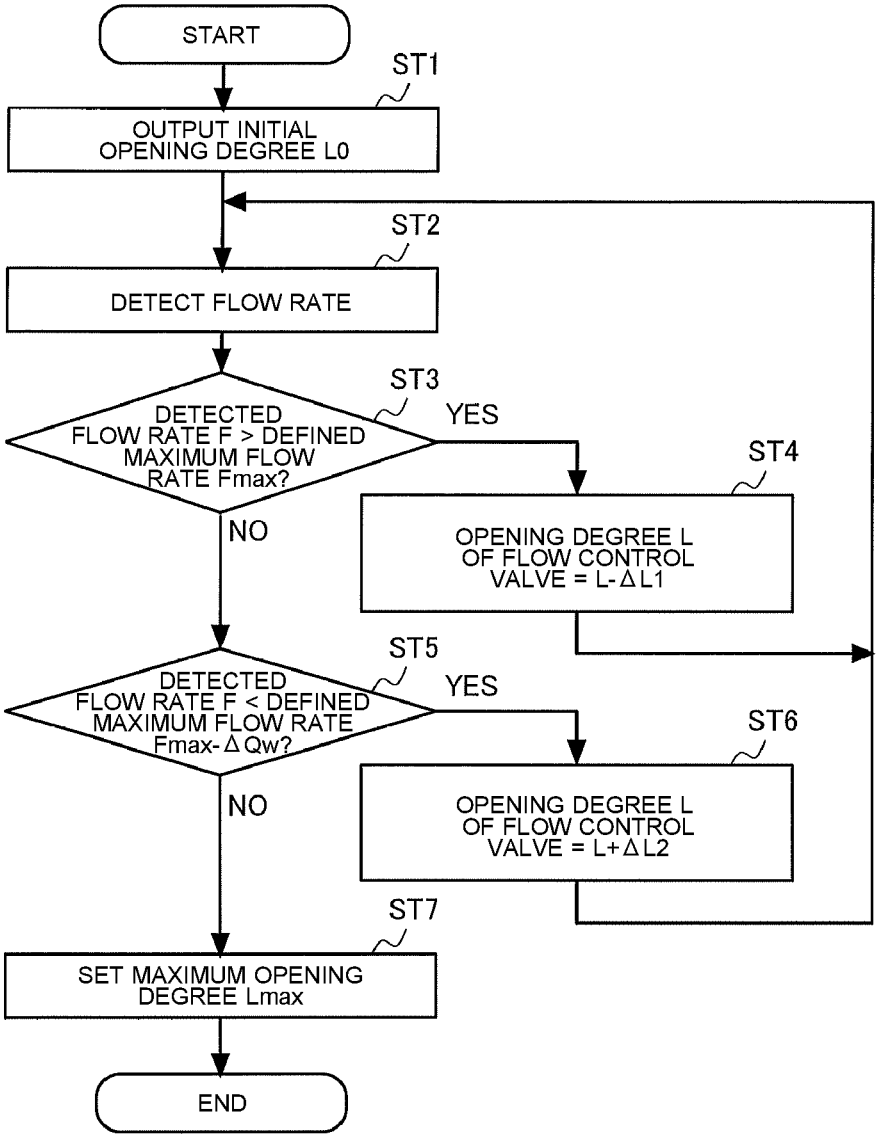
FIG. 9 is a flowchart of an operation of the air-conditioning apparatus 100 according to Embodiment 1 of the present invention.

FIG. 9 is a flowchart indicating an operation of the air-conditioning apparatus 100 according to Embodiment 1 of the present invention. Next, the control of the flow control valve 60 by the controller 50 will be described. First of all, the operation of the maximum setting unit 52*a* will be described. As illustrated in FIG. 9, first, the controller 50 performs a control to set the opening degree of the flow control valve 60 to the initial opening degree L0 (step ST1). Next, the flow rate of the heat-source heat medium that flows through the heat medium circuit 100B is detected by the flow rate sensor 63 (step ST2).

Then, it is determined whether or not the detected flow rate F is higher than the defined maximum flow rate Fmax stored in the storage unit 51 (step ST3). When the detected flow rate F is higher than the defined maximum flow rate Fmax (YES in step ST3), the maximum setting unit 52*a* decreases the opening degree L of the flow control valve 60 by the regulation opening degree ΔL1 (step ST4). Then, the process returns to step ST2, and the maximum setting unit 52*a* repeatedly decreases the opening degree L by the regulation opening degree ΔL1 until the detected flow rate F falls below the defined maximum flow rate Fmax.

When the detected flow rate F is lower than or equal to the defined maximum flow rate Fmax (NO in step ST3), it is determined whether or not the detected flow rate F is lower than the value obtained by subtracting the allowable flow rate ΔQw from the defined maximum flow rate Fmax (step ST5). When the detected flow rate F is lower than the value obtained by subtracting the allowable flow rate ΔQw from the defined maximum flow rate Fmax (YES in step ST5), the maximum setting unit 52*a* increases the opening degree L of the flow control valve 60 by the regulation opening degree ΔL2 (step ST6). Then, the process returns to step ST2, and the maximum setting unit 52*a* repeatedly increases the opening degree L by the regulation opening degree ΔL2 until the detected flow rate F exceeds the value obtained by subtracting the allowable flow rate ΔQw from the defined maximum flow rate Fmax.

When the detected flow rate F is higher than the value obtained by subtracting the allowable flow rate ΔQw from the defined maximum flow rate Fmax (NO in step ST5), the maximum setting unit 52*a* sets the set opening degree L at that time as the maximum opening degree Lmax (step ST7). It should be noted that the regulation opening degree ΔL1 is greater than the regulation opening degree ΔL2.

Figure 10:
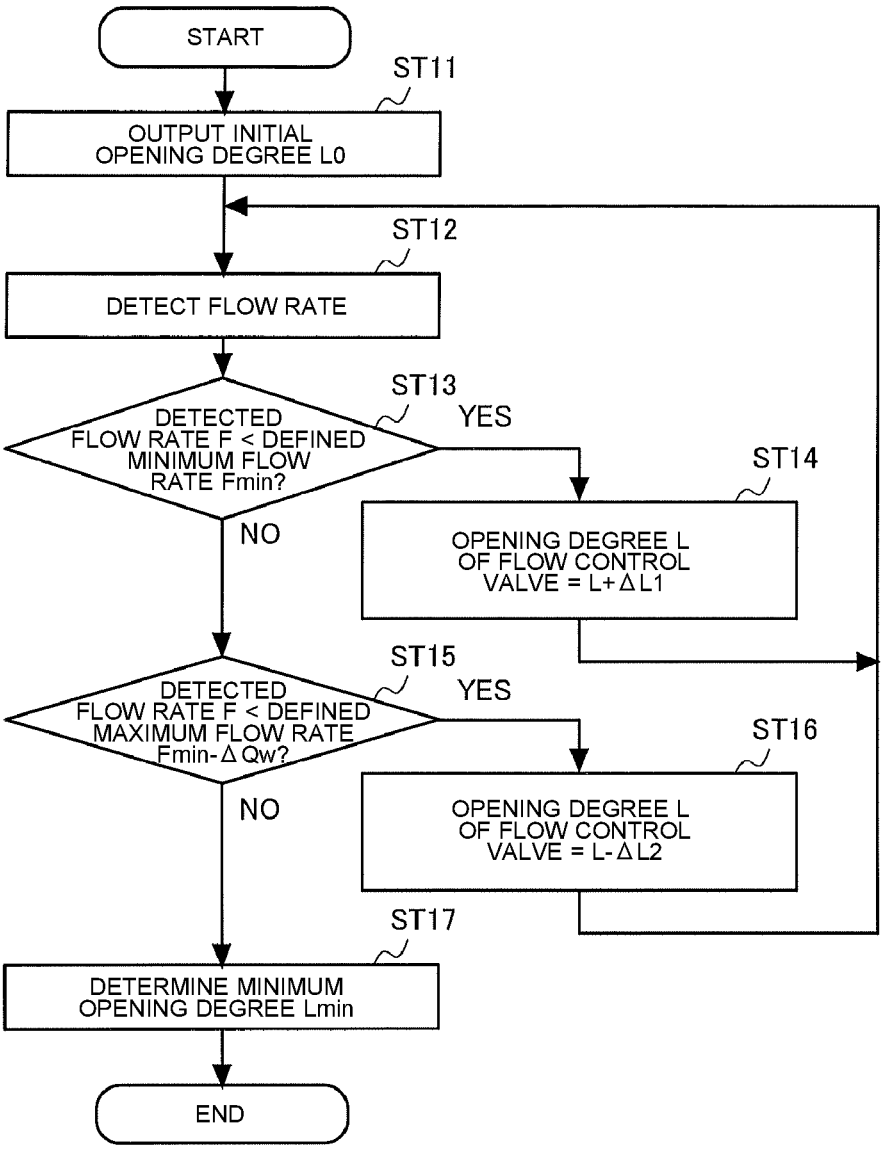
FIG. 10 is a flowchart of another operation of the air-conditioning apparatus 100 according to Embodiment 1 of the present invention.

FIG. 10 is a flowchart of another operation of the air-conditioning apparatus 100 according to Embodiment 1 of the present invention. Next, the operation of the minimum setting unit 52*b* will be described. As illustrated in FIG. 10, the controller 50 performs a control to set the opening degree of the flow control valve 60 to the initial opening degree L0 (step ST11). Next, the flow rate of the heat-source heat medium that flows in the heat medium circuit 100B is detected by the flow rate sensor 63 (step ST12).

Then, it is determined whether or not the detected flow rate F is lower than the defined minimum flow rate Fmin stored in the storage unit 51 (step ST13). When the detected flow rate F is lower than the defined minimum flow rate Fmin (YES in step ST13), the minimum setting unit 52*b* increases the opening degree L of the flow control valve 60 by the regulation opening degree ΔL1 (step ST14). Then, the process returns to step ST12, and the minimum setting unit 52*b* repeatedly increases the opening degree L by the regulation opening degree ΔL1 until the detected flow rate F exceeds the defined minimum flow rate Fmin.

When the detected flow rate F is higher than or equal to the defined minimum flow rate Fmax (NO in step ST13), it is determined whether or not the detected flow rate F is higher than the value obtained by adding the allowable flow rate ΔQw to the defined minimum flow rate Fmin (step ST15). When the detected flow rate F is higher than the value obtained by adding the allowable flow rate ΔQw to the defined minimum flow rate Fmin (YES in step ST15), the minimum setting unit 52*b* decreases the opening degree L of the flow control valve 60 by the regulation opening degree ΔL2 (step ST16). Then, the process returns to step ST12, and the minimum setting unit 52*b* repeatedly decreases the opening degree L by the regulation opening degree ΔL2 until the detected flow rate F falls below the value obtained by adding the allowable flow rate ΔQw to the defined minimum flow rate Fmin.

When the detected flow rate F is lower than the value obtained by adding the allowable flow rate ΔQw to the defined minimum flow rate Fmin (NO in step ST15), the minimum setting unit 52*b* determines the set opening degree L at that time as the minimum opening degree Lmin (step ST17). It should be noted that the regulation opening degree ΔL1 is greater than the regulation opening degree ΔL2.

According to Embodiment 1, the controller 50 stores data indicating the defined maximum flow rate and the defined minimum flow rate of the heat-source heat medium that flows in the heat medium circuit 100B. Therefore, the controller 50 can automatically regulate the opening degree of the flow control valve 60, based on the defined maximum flow rate Fmax and the defined minimum flow rate Fmin. Thus, it is possible to reduce the time required to regulate the opening degree of the flow control valve 60 and also to reduce the variation between regulation processing by different operators. Furthermore, the opening-degree setting unit 52 of the controller 50 sets the maximum opening degree and the minimum opening degree of the flow control valve 60 based on the flow rate detected by the flow rate sensor 63, the defined maximum flow rate Fmax stored in the storage unit 51, and the defined minimum flow rate Fmin stored in the storage unit 51. As described above, in Embodiment 1, the maximum opening degree and the minimum opening degree of the flow control valve 60 are automatically set.

In an existing water-cooled air conditioning apparatus, since the flow rate of the cooling water that can be made to flow to an outdoor water heat exchanger is determined in advance, it is necessary to regulate the maximum opening degree and the minimum opening degree of a water-amount regulation valve at the time of performing a trial operation. In that case, on-side, an operator causes the water-cooled air conditioning apparatus to operate, and manually adjust a water-amount regulation value. However, since the operator manually adjusts the water-amount regulation valve, it takes long time to adjust the water-amount regulation valve, and the adjustment of the water-amount regulation valve varies from one operator to another, because operators have different technical skills. By contrast, in Embodiment 1, since the maximum opening degree and the minimum opening degree of the flow control valve 60 are automatically set, the operator does not need to manually regulate the water-amount regulation value. It is therefore possible to shorten the time for regulation, and there is no variation between regulation processing by different operators.

Also, in the past, an air-conditioning apparatus in which the opening degree of a flow control valve is changed in accordance with the rotation speeds of an indoor fan and a compressor has been known. In this air-conditioning apparatus, the opening degree of the flow control valve cannot be changed unless the compressor and the indoor fan are in operation, and it takes a lot of time to regulate the opening degree of the flow control valve such that the flow rate of refrigerant supplied to a heat-source-side heat exchanger at the time of performing a trial operation falls within a defined flow rate range. Therefore, re-regulation of the opening degree is repeated, and the efficiency of the trial operation is thus reduced.

By contrast, the opening-degree setting unit 52 of Embodiment 1 sets the maximum opening degree and the minimum opening degree of the flow control valve 60 based on the defined maximum flow rate Fmax and the defined minimum flow rate Fmin stored in the storage unit 51. Thus, it is possible to set the maximum opening degree and the minimum opening degree of the flow control valve 60 regardless of whether the compressor 10 is in operation or not. Therefore, the opening-degree setting unit 52 of Embodiment 1 can set the maximum opening degree and the minimum opening degree of the flow control valve 60 even when the compressor 10 is not in operation. Accordingly, at the time of performing the trial operation, it is not necessary to repeat regulation of the opening degree of the flow control valve 60 such that the flow rate falls within the flow rate range. It is therefore possible to greatly improve the efficiency of the trial operation. Furthermore, since the maximum opening degree and the minimum opening degree of the flow control valve 60 can be set even when the compressor 10 is not in operation, the opening degree of the flow control valve 60 can be regulated even when construction of the refrigerant pipes has not been completed.

(Modification)

Figure 11:
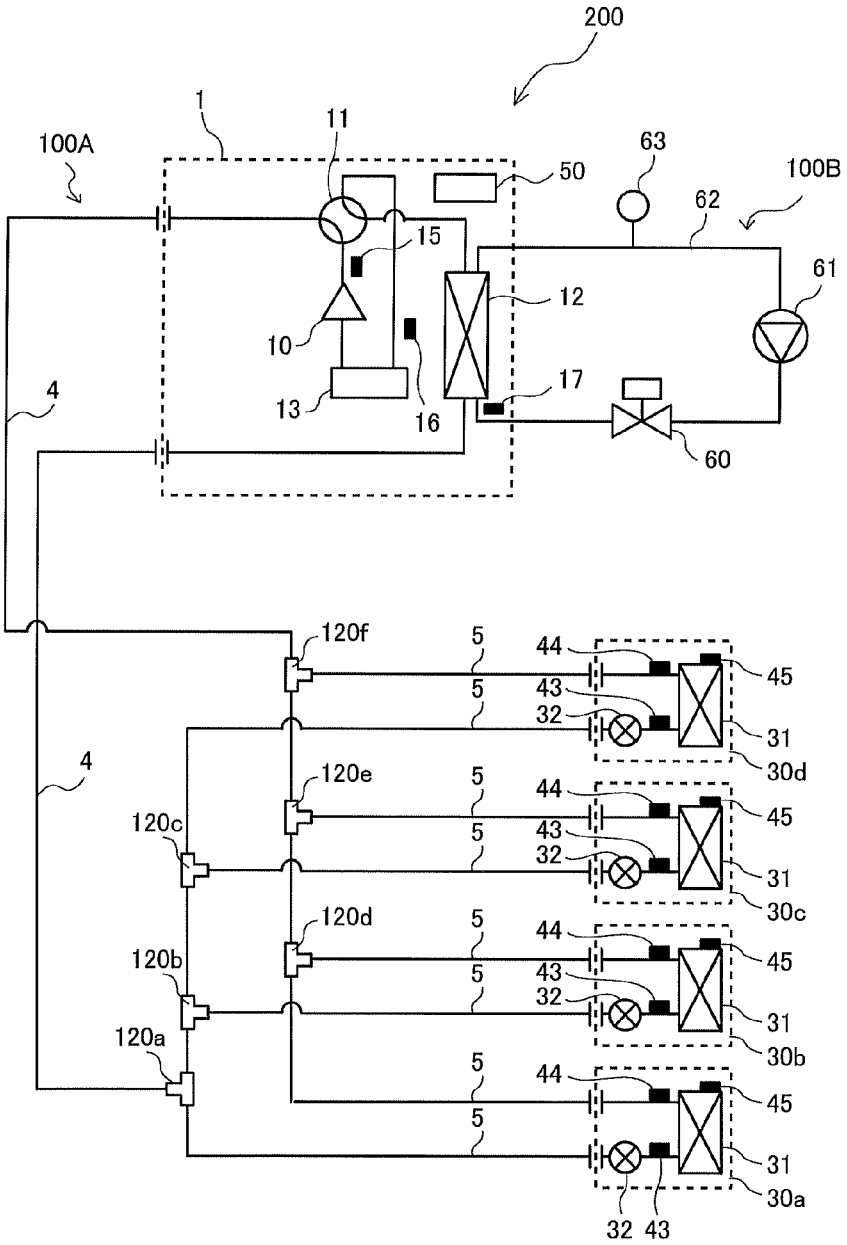
FIG. 11 is a circuit diagram of an air-conditioning apparatus 200 according to a modification of Embodiment 1 of the present invention.

FIG. 11 is a circuit diagram of an air-conditioning apparatus 200 according to a modification of Embodiment 1 of the present invention. In the modification, the cooling only operation and the heating only operation can be performed, and a relay device 20 is not provided. The air-conditioning apparatus 200 includes six joints connecting three refrigerant pipes 4, between the heat source apparatus 1 and the indoor units 30*a* to 30*d*.

Between the refrigerant pipes 4 connected to the heat-source-side heat exchanger 12 and the refrigerant pipes 5 connected to the expansion units 32, three joints, that is, a first joint 120*a*, a second joint 120*b*, and a third joint 120*c*, are connected in series. The first joint 120*a*, the second joint 120*b*, and the third joint 120*c* are connected to the expansion units 32 of the four indoor units 30*a* to 30*d*.

Between the refrigerant pipes 4 connected to the first flow switching device 11 and the refrigerant pipes 5 connected to the load-side heat exchangers 31, three joints, that is, a sixth joint 120*f*, a fifth joint 120*e*, and a fourth joint 120*d*, are connected in series. The sixth joint 120*f*, the fifth joint 120*e*, and the fourth joint 120*d* are connected to the load-side heat exchangers 31 of the four indoor units 30*a* to 30*d*.

Next, the operations in the operation modes of the air-conditioning apparatus 200 will be described. As described above, the air-conditioning apparatus 200 can perform the cooling only operation and the heating only operation as operation modes.

(Cooling Only Operation)

First of all, the cooling only operation will be described. Low-temperature, low-pressure refrigerant is sucked into the compressor 10, and high-temperature, high-pressure gas refrigerant discharged from the compressor 10 passes through the first flow switching device 11 and flows into the heat-source-side heat exchanger 12 that operates as a radiator. The refrigerant that has flowed into the heat-source-side heat exchanger 12 transfers heat to the heat-source heat medium in the heat-source-side heat exchanger 12, and is liquefied. The liquefied high-pressure liquid refrigerant passes through the refrigerant pipe 4 and reaches the first joint 120*a*. At the first joint 120*a*, the refrigerant branches into refrigerant that flows toward the indoor unit 30*a* and refrigerant that flows toward the second joint 120*b*. When the refrigerant that flows toward the second joint 120*b* reaches the second joint 120*b*, it branches thereat into refrigerant that flows toward the indoor unit 30*b* and refrigerant that flows toward the third joint 120*c*. When the refrigerant that flows toward the third joint 120*c* reaches the third joint 120*c*, it branches thereat into refrigerant that flows toward the indoor unit 30*c* and refrigerant that flows toward the indoor unit 30*d*.

In each of the indoor units 30*a* to 30*d*, the refrigerant that has flowed thereinto indoor unit is expanded by the expansion unit 32 to change into low-temperature, low-pressure two-phase gas-liquid refrigerant. The two-phase gas-liquid refrigerant flows into the load-side heat exchanger 31 that operates as an evaporator, and sucks heat from the indoor air that is a load heat medium to thereby cool the indoor air, and becomes low-temperature, low-pressure gas refrigerant. At that time, the indoor space is cooled. The gas refrigerant that has flowed out of the indoor unit 30*a* passes through the fourth joint 120*d*, the fifth joint 120*e*, and the sixth joint 120*f*, reaches the refrigerant pipe 4, and re-flows into the heat source apparatus 1.

The gas refrigerant that has flowed out of the indoor unit 30*b* passes through the fourth joint 120*d*, the fifth joint 120*e*, and the sixth joint 120*f*, reaches the refrigerant pipe 4, and re-flows into the heat source apparatus 1. The gas refrigerant that has flowed out of the indoor unit 30*c* passes through the fifth joint 120 and the sixth joint 120*f*, reaches the refrigerant pipe 4, and re-flows into the heat source apparatus 1. The gas refrigerant that has flowed out of the indoor unit 30*d* passes through the sixth joint 120, reaches the refrigerant pipe 4, and re-flows into the heat source apparatus 1. The refrigerant that has flowed into the heat source apparatus 1 passes through the fourth check valve 14*d* and is re-sucked into the compressor 10 via the flow switching device 11 and the accumulator 13.

Next, the flow of the heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant, and is heated. The heated heat-source heat medium is re-sucked into the pump 61.

(Heating Only Operation)

Next, the heating only operation will be described. Low-temperature, low-pressure refrigerant is sucked into the compressor 10, and high-temperature, high-pressure gas refrigerant discharged from the compressor 10 passes through the first flow switching device 11 and reaches the sixth joint 120*f* through the refrigerant pipe 4. At the sixth joint 120*f*, the refrigerant branches into refrigerant that flows toward the indoor unit 30*d* and refrigerant that flows toward the fifth joint 120*e*. When the refrigerant that flows toward the fifth joint 120*e* reaches the fifth joint 120*e*, it branches thereat into refrigerant that flows toward the indoor unit 30*c* and refrigerant that flows toward the fourth joint 120*d*. When the refrigerant flowing toward the fourth joint 120*d* reaches the fourth joint 120*d*, it branches thereat into refrigerant that flows toward the indoor unit 30*d* and refrigerant that flows toward the indoor unit 30*a*.

In each of the indoor units 30*a* to 30*d*, the refrigerant that has flowed thereinto flows into the load-side heat exchanger 31 that operates as a condenser, and transfers heat to the indoor air that is a load heat medium to thereby heat the indoor air, and becomes liquid refrigerant. At that time, the indoor space is heated. The liquid refrigerant that has flowed out of the load-side heat exchanger 31 is expanded by the expansion unit 32 and becomes low-temperature, low-pressure two-phase gas-liquid refrigerant.

The refrigerant that has flowed out of the indoor unit 30*d* passes through the third joint 120*c*, the second joint 120*b*, and the first joint 120*a*, reaches the refrigerant pipe 4, and re-flows into the heat source apparatus 1. The gas refrigerant that has flowed out of the indoor unit 30*c* passes through the third joint 120*c*, the second joint 120*b*, and the first joint 120*a*, reaches the refrigerant pipe 4, and flows into the heat source apparatus 1 again. The refrigerant that has flowed out of the indoor unit 30*b* passes through the second joint 120*b* and the first joint 120*a*, reaches the refrigerant pipe 4, and re-flows into the heat source apparatus 1. The refrigerant that has flowed out of the indoor unit 30*a* passes through the first joint 120, reaches the refrigerant pipe 4, and re-flows into the heat source apparatus 1.

The refrigerant that has flowed into the heat source apparatus 1 passes through the second check valve 14*b*, and flows into the heat-source-side heat exchanger 12 that operates as an evaporator. The refrigerant that has flowed into the heat-source-side heat exchanger 12 receives heat from the heat-source heat medium in the heat-source-side heat exchanger 12 and becomes low-temperature, low-pressure gas refrigerant. The low-temperature, low-pressure gas refrigerant that has flowed out of the heat-source-side heat exchanger 12 is re-sucked into the compressor 10 via the flow switching device 11 and the accumulator 13.

Next, the flow of the heat-source heat medium in the heat medium circuit 100B will be described. The heat-source heat medium sucked into the pump 61 is discharged from the pump 61, passes through the flow control valve 60, and flows into the heat-source-side heat exchanger 12. The heat-source heat medium that has flowed into the heat-source-side heat exchanger 12 exchanges heat with the refrigerant and is cooled. The cooled heat-source heat medium is re-sucked into the pump 61.

Even in the case where the relay device 20 is not provided as in the modification, it is possible to obtain the same advantages as in Embodiment 1 in the case where the controller 50 stores data indicating the defined maximum flow rate Fmax and the defined minimum flow rate Fmin of the heat-source heat medium flowing through the heat medium circuit 100B. As described above, the configuration of the flow passage for refrigerant using the above pipe connection, and the devices forming the refrigerant circuit 100A, such as the compressor 10, the heat exchanger, and the expansion unit 32, can be changed as appropriate.

REFERENCE SIGNS LIST

1 heat source apparatus, 4 refrigerant pipe, 4*a* high-pressure pipe, 4*b* low-pressure pipe, 5, 5*a*, 5*b* refrigerant pipe, 7 notification unit, 10 compressor, 11 first flow switching device, 12 heat-source-side heat exchanger, 13 accumulator, 14 heat-source-side flow regulating unit, 14*a* first check valve, 14*b* second check valve, 14*c* third check valve, 14*d* fourth check valve, 15 discharge pressure sensor, 16 suction pressure sensor, 17 heat medium temperature sensor, 20 relay device, 21 gas-liquid separator, 21*a* gas pipe, 21*b* liquid pipe, 22 first expansion device, 23 second expansion device, 24*a*, 24*b*, 24*c*, 24*d* second flow switching device, 25*a* first open/close device, 25*b* second open/close device, 26*a* fifth check valve, 26*b* sixth check valve, 30*a*, 30*b*, 30*c*, 30*d* indoor unit, 31 load-side heat exchanger, 32 expansion unit, 41 first pressure sensor, 42 second pressure sensor, 43 first load temperature sensor, 44 second load temperature sensor, 45 air temperature sensor, 50 controller, 51 storage unit, 52 opening-degree setting unit, 52*a* maximum setting unit, 52*b* minimum setting unit, 60 flow control valve, 61 pump, 62 heat medium pipe, 63 flow rate sensor, 100 air-conditioning apparatus, 100A refrigerant circuit, 100B heat medium circuit, 120*a* first joint, 120*b* second joint, 120*c* third joint, 120*d* fourth joint, 120*e* fifth joint, 120*f* sixth joint, 200 air-conditioning apparatus

The invention claimed is:

1. An air-conditioning apparatus comprising:

a refrigerant circuit in which a compressor, a heat-source-side heat exchanger, an expansion valve, and a load-side heat exchanger are connected by refrigerant pipes, refrigerant flowing in the refrigerant circuit when operational, the compressor being configured to compress the refrigerant, the heat-source-side heat exchanger being configured to cause heat exchange to be performed between the refrigerant and a heat-source heat medium, the expansion valve being configured to expand the refrigerant, the load-side heat exchanger being configured to cause heat exchange to be performed between the refrigerant and a load heat medium;

a heat medium circuit in which a flow control valve and the heat-source-side heat exchanger are connected by a heat medium pipe, the heat-source heat medium flowing in the heat medium circuit when operational, the flow control valve being configured to regulate a flow rate of the heat-source heat medium;

a controller including a storage unit configured to store data indicating a defined maximum flow rate and a defined minimum flow rate of the heat-source heat medium that flows in the heat medium circuit; and a flow rate sensor provided at the heat medium pipe and configured to detect a flow rate of the heat-source heat medium that flows in the heat medium circuit, wherein the controller further includes an opening-degree setting unit configured to set a maximum opening degree and a minimum opening degree of the flow control valve, based on the flow rate detected by the flow rate sensor and the defined maximum flow rate and the defined minimum flow rate both stored as the data in the storage unit.

2. The air-conditioning apparatus of claim 1, wherein the heat medium circuit includes a pump configured to transfer the heat-source heat medium, and the opening-degree setting unit includes a maximum setting unit configured to set the maximum opening degree by decreasing the opening degree of the flow control valve by a regulation opening degree, in a case where the pump is driven by a set output, when the detected flow rate exceeds the defined maximum flow rate, and set the maximum opening degree by increasing the opening degree of the flow control valve by the regulating opening degree, in a case where the pump is driven by the set output, when the detected flow rate falls below a value obtained by subtracting an allowable flow rate from the defined maximum flow rate.

3. The air-conditioning apparatus of claim 1, wherein the heat medium circuit includes a pump configured to transfer the heat-source heat medium, and the opening-degree setting unit further includes a minimum setting unit configured to set the minimum opening degree by increasing the opening degree of the flow control valve by a regulation opening degree, in a case where the pump is driven by a set output, when the detected flow rate falls below the defined minimum flow rate, and set the minimum opening degree by decreasing the opening degree of the flow control valve by the regulation opening degree, in a case where the pump is driven by the set output, when the detected flow rate exceeds a value obtained by adding an allowable flow rate to the defined minimum flow rate.

4. The air-conditioning apparatus of claim 1, wherein the flow rate sensor is a flowmeter.

5. The air-conditioning apparatus of claim 1, wherein the flow rate sensor is a pressure gauge configured to detect a pressure of the heat medium that flows to an inlet side of the heat-source-side heat exchanger and to and an outlet side of the heat-source-side heat exchanger.

6. The air-conditioning apparatus of claim 1, wherein the opening-degree setting unit sets the maximum opening degree and the minimum opening degree of the flow control valve when the compressor is in a stopped state.

7. The air-conditioning apparatus of claim 1, wherein the defined maximum flow rate and the defined minimum flow rate are set by a changeover switch included in the controller or by an external input.

* * * * *